US010137684B2

(12) United States Patent
Horade et al.

(10) Patent No.: US 10,137,684 B2
(45) Date of Patent: Nov. 27, 2018

(54) IMAGE RECORDING APPARATUS

(71) Applicant: BROTHER KOGYO KABUSHIKI KAISHA, Nagoya, Aichi (JP)

(72) Inventors: Kenta Horade, Tokai (JP); Tetsuya Ouchi, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/708,838

(22) Filed: Sep. 19, 2017

(65) Prior Publication Data

US 2018/0147842 A1 May 31, 2018

(30) Foreign Application Priority Data

Nov. 30, 2016 (JP) ..... 2016-233556

(51) Int. Cl.
*B41J 2/045* (2006.01)

(52) U.S. Cl.
CPC ..... *B41J 2/04573* (2013.01); *B41J 2/0457* (2013.01); *B41J 2/04548* (2013.01)

(58) Field of Classification Search
CPC ... B41J 2/04573; B41J 2/0457; B41J 2/04548
See application file for complete search history.

(56) References Cited

U.S. PATENT DOCUMENTS 5,708,821 A * 1/1998 Takikita ..... B41J 29/387 358/1.14
6,938,979 B2 * 9/2005 Sum ..... B41J 2/16517 347/23
2006/0007487 A1 1/2006 Okazawa
2012/0229538 A1 * 9/2012 Suzuki ..... B41J 2/04543 347/9

FOREIGN PATENT DOCUMENTS

JP 2004-042422 A 2/2004
JP 2005-284774 A 10/2005
JP 4537133 B2 9/2010

* cited by examiner

*Primary Examiner* — Henok Legesse
(74) *Attorney, Agent, or Firm* — Scully, Scott, Murphy & Presser, PC

(57) ABSTRACT

A controller of an inkjet recording apparatus is configured to calculate an energized time length during which a timer is in an energized state after a particular calculation start point for calculating a lapse time length based on a time measured by the timer and store the energized time length, determine whether there exists a non-energized state after the calculation start point, estimate the non-energized time length, referring to the energized time length and a time length parameter stored in a memory when it is determined that there exists the non-energized state after the calculation start point, and calculate the lapse time length elapsed from the calculation start point based on the non-energized time length estimated in the estimation process and the energized time length stored in the memory.

20 Claims, 11 Drawing Sheets

IMAGE RECORDING APPARATUS

CROSS-REFERENCE TO RELATED APPLICATIONS

This application claims priority under 35 U.S.C. § 119 from Japanese Patent Application No. 2016-233556 filed on Nov. 30, 2016. The entire subject matter of the application is incorporated herein by reference.

BACKGROUND

Technical Field

The present disclosures relate an image recording apparatus.

Related Art

Conventionally, there is known an inkjet printing apparatus which has an inkjet head, a recovery system device forcibly causing the inkjet head to discharge ink from discharging nozzles, a RAM storing periodically incremented time information (i.e., printer time) when an AC power is supplied, and an EEPROM storing an ink discharged time representing a time when the ink was previously discharged by the recovery system device. In such a conventional inkjet printing apparatus, various processes are executed based on the time information stored in the RAM. For example, whether discharge of the ink by the recovery system device is to be done or not is determined based on a lapse time length from a previous ink discharge time point by comparing the time information and the ink discharged time stored in the EEPROM.

SUMMARY

If the inkjet printing apparatus as described above is powered off as, for example, an AC power plug is removed from an electrical outlet, the time information stored in the RAM becomes inaccurate, and the lapse time length from the previous ink discharge time point becomes unknown.

In order to deal with such a situation, typically, the ink discharged time stored in the EEPROM is stored in the RAM as the time information when the AC power is supplied again after the power-off of the inkjet printing apparatus. Thereafter, if the time information representing a current time (i.e., print time) is received from a host computer when a printing operation is started, the time information stored in the RAM is updated to the received time information. Further, by comparing the received time information with the ink discharged time, whether the discharge of the ink by the recovery system device is to be performed or not is determined. If the time information representing the current time is not received when the printing operation is started, discharge of the ink by the recovery system device is performed without updating the time information stored in the RAM.

According to the conventional inkjet printing apparatus as described above, after the power-off as, for example, the power plug is removed from the electrical outlet, if the time information is not received from the host computer when the printing operation is started, discharge of the ink by the recovery system device is performed with ignoring a period during which the inkjet printing apparatus had been powered off. Therefore, the ink could be discharged unnecessarily. That is, according to the conventional inkjet printing apparatus, when it is once powered off, unless the time information is received from the host computer, a process related to a lapse time length from a particular calculation start point cannot be performed appropriately.

According to aspects of the present disclosures, there is provided an image recording apparatus, which has a timer, a power generator configured to receive electrical power from a power supply, and supply the electrical power to the timer as driving electrical power, a memory and a controller. The memory stores a time length parameter representing a ratio of an energized time length when the timer is in an energized state where the timer is receiving the driving electrical power from the power generator to a fundamental cycle time length which is a time length parameter used for estimation of a non-energized time length when the timer is in an non-energized state where the timer is not receiving the driving electrical power from the power generator and is based on a cyclic nature of a calendar. The controller is configured to execute a storing process of calculating the energized time length during which the timer is in the energized state after a particular calculation start point based on a time measured by the timer and store the energized time length as calculated, a determining process of determining whether there exists the non-energized state after the calculation start point, an estimation process of estimating the non-energized time length, referring to the energized time length and the time length parameter stored in the memory when it is determined in the determining process that there exists the non-energized state after the calculation start point, and a lapse time length calculation process of calculating the lapse time length elapsed from the calculation start point based on the non-energized time length estimated in the estimation process and the energized time length stored in the memory.

According to aspects of the present disclosures, there is provided an image recording apparatus which has a timer, a power generator configured to receive electrical power from a power supply, and supply the electrical power to the timer as driving electrical power, a memory and a controller. The memory stores a time length parameter representing a ratio of an energized time length when the timer is in an energized state where the timer is receiving the driving electrical power from the power generator to a fundamental cycle time length which is a time length parameter used for estimation of a non-energized time length when the timer is in an non-energized state where the timer is not receiving the driving electrical power from the power generator and is based on a cyclic nature of a receiving state, in the timer, of the driving electrical power from the power generator. The controller is configured to execute a storing process of calculating the energized time length during which the timer is in the energized state after a particular calculation start point based on a time measured by the timer and store the energized time length as calculated, a determining process of determining whether there exist the non-energized state after the calculation start point, an estimation process of estimating the non-energized time length, referring to the energized time length and the time length parameter stored in the memory when it is determined in the determining process that there exists the non-energized state after the calculation start point, and a lapse time length calculation process of calculating the lapse time length after the calculation start point based on the non-energized time length estimated in the estimation process and the energized time length stored in the memory.

According to aspects of the present disclosures, there is provided an image recording apparatus, having a timer, a power generator configured to receive electrical power from a power supply, and supply the electrical power to the timer as driving electrical power, a memory and a controller. The controller is configured to execute a storing process of storing a measured time length measured by the timer from a calculation start point, which is a start point to calculate the lapse time length when the timer in an energized state where the timer is receiving a driving electrical power from the power generator, a state determining process of determining whether there has occurred a non-energized state where the timer is not receiving the driving electrical power after the calculation start point. When it is determined in the state determining process that there exists the non-energized state after the calculation start point, the controller executes a condition determining process of determining whether a condition in which the receiving interface newly receives second time information as the time information when the receiving interface has externally received first time information as the time information, and after the state of the timer has changed from the non-energized sate to the energized state. When it is determined that the condition is not satisfied in the condition determining process, an estimate process estimating the non-energized time length referring to internal information obtained inside the image recording process. When it is determined that the condition is satisfied in the condition determining process, the controller calculates a lapse time length from the calculation start point as a measured time length referring to the first time information and the second time information. When it is determined that the condition is not satisfied in the condition determining process, the controller executes a lapse time length calculation process of calculating a lapse time from the calculation start point as an estimate time length based on the non-energized time length estimated in the estimation process and the clocked time length stored in the memory.

BRIEF DESCRIPTION OF THE ACCOMPANYING DRAWINGS

FIG. 1 schematically shows a configuration of an inkjet printer according to a first illustrative embodiment of the present disclosures.

DETAILED DESCRIPTION OF THE EMBODIMENTS

First Illustrative Embodiment

Figure 1:
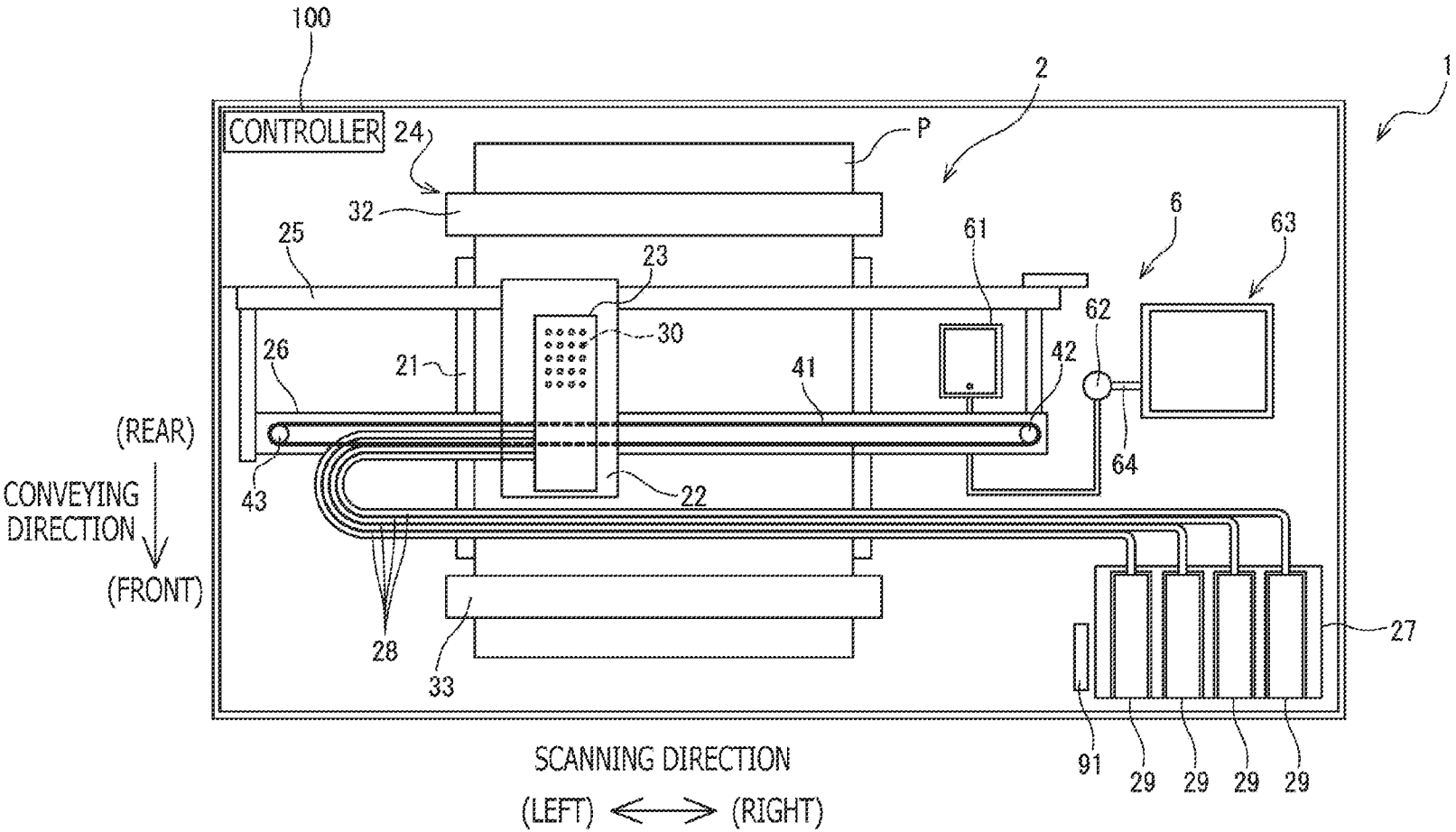

Hereinafter, referring to the accompanying drawings, an inkjet printer 1 (hereinafter, simply referred to as a "printer") according to a first illustrative embodiment will be described. As shown in FIG. 1, the printer 1 mainly has an image recorder 2, a maintenance device 6, a user I/F 90 (see FIG. 2), a temperature sensor 91, a power generator 95 (see FIG. 2), and a controller 100. It is noted that, in the following description, a closer direction with respect to a plane of FIG. 1 will be referred to as an upside of the printer 1, and a farther direction with respect to the plane of FIG. 1 will be referred to as a downside of the printer 1. Further, front, rear, right and left directions indicated in FIG. 1 will be referred to as front, rear, right and left directions of the printer 1, respectively. In the following direction, expressions such as a front-rear direction, a right-left direction, and an up-down direction will also be used to indicate directions with respect to the printer 1.

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storages, hard disk drives, floppy drives, permanent storages, and the like.

The image recorder 2 has a platen 21, a carriage 22 which is configured to reciprocally move in the right-left direction (which will also be referred to as a scanning direction), an inkjet head 23 mounted on the carriage 22, and a conveying device 24 configured to convey a recording sheet P, which is a recording medium on which an image is recorded, in a horizontal direction (which will also be referred to as a conveying direction).

Multiple recording sheets P are to be placed on an upper surface of the platen 21. Further, above the platen 21, two guide rails 25 and 26, which parallelly extend in the scanning direction, are provided. The carriage 22 is slidably mounted on the two guide rails 25 and 26, and is configured to move, as guided by the guide rails 25 and 26, in the scanning direction within an area facing the recording sheet P placed on the platen 21. Further, the carriage 22 is secured to a driving belt 41. The driving belt 41 is an endless belt wound around two pulleys 42 and 43. One pulley 42 is connected to a carriage driving motor 31 (see FIG. 2). As the carriage driving motor 31 rotates and the pulley 42 is driven thereby to rotate, the driving belt 41 moves to move the carriage 22 in the scanning direction.

The inkjet head 23 is secured to a lower part of the carriage 22 such that a gap is formed between the inkjet head 23 and the platen 21. A lower surface of the inkjet head 23 is formed to be an ink ejecting surface on which multiple nozzles 30 are opened (i.e., openings of the nozzles 30 are formed) (not shown). It is also noted that the multiple nozzles 30 are arranged in four lines, each line extending along the conveying direction. The four lines of the nozzles 30 are configured to eject four-color ink (i.e., black, yellow, cyan and magenta) respectively. The inkjet head 23 is connected to a holder 27 through four tubes 28. The ink (i.e., black ink, yellow ink, cyan ink and magenta ink) in four ink cartridges 29 held by the holder 27 is supplied to the inkjet head 23 through the four tubes 28, respectively.

The inkjet head 23 has multiple driving elements (not shown) configured to apply ejection energy to the ink in each of the multiple color ink in the multiple nozzles 30, and a driving IC 35 (see FIG. 2) configured to drive the multiple driving elements. As the driving elements, piezoelectric elements, or heat generating bodies configured to apply heat to the ink to cause film boiling may be preferably employed. The driving IC 35 drives each of the multiple driving elements by supplying a driving signal having particular waveform to each driving element.

It is noted that the inkjet head 23 is movable, together with the carriage 22, within not only a range facing the recording sheet P conveyed on the platen 21 (hereinafter, referred to as a facing range), but to positions on right and left sides with respect to the facing range. On the right side with respect to the facing range, a maintenance device (described later) 6 is arranged.

The conveying device 24 has two conveying rollers 32 and 33, which are arranged, in the conveying direction, at front and rear positions, with respect to the platen 21 and the carriage 23. The two conveying rollers 32 and 33 are synchronously driven to rotate by a conveying motor 34 (see FIG. 2), thereby conveying the recording sheet P frontward, in the conveying direction, between the inkjet head 23 and the platen 21.

In the configuration described above, the image recorder 2 prints a desired image or the like on the recording sheet P by causing the conveying device 24 to convey the recording sheet P in the conveying direction, and by moving the carriage 22, together with the inkjet head 23, in the scanning direction with causing the inkjet head 23 to discharge the ink. That is, the printer 1 according to the first illustrative embodiment is a so-called serial type inkjet printer.

The maintenance device 6 is for maintaining/recovering discharge characteristics of the inkjet head 23. The maintenance device 6 has a cap member 61, a suction pump 62, a waste liquid collecting device 63, a discharging pipe 64 and the like. The maintenance device 6 is arranged on the right side with respect to the facing range where the inkjet head 23 faces the recording sheet P conveyed on the platen 21, as mentioned above. When the inkjet head 23 is located on the right side with respect to the facing range, the inkjet head 23 faces the cap member 61 in the up-down direction. Further, the cap member 61 is driven to move in the up-down direction by the cap driving motor 65 (see FIG. 2). According to the above configuration, the cap member 61 is movable between a capping position where the cap member 61 closely contacts the ink discharge surface of the inkjet head 23, and an uncapping position where the cap member 61 is separated from the ink discharge surface of the inkjet head 23.

The discharging pipe 64 form a flow channel extending from the cap member 61 to the waste liquid collecting device 63 through the suction pump 62. The suction pump 62 is connected to the cap member 61. When the cap member 61 is located at the capping position, by causing the suction pump 62 to decompress inside of the cap member 61, ink is forcibly discharged from the multiple nozzles 30 into the cap member 61. Such an ink discharging operation is generally known as a suction purge. By the suction purge, it is possible to discharge air bubbles and/or dusts mixed in the ink, viscosity-increased ink and the like. The ink discharged from the inkjet head 23 by the suction purge is sent to the waste liquid collecting device 63 through the discharging pipe 64.

Figure 2:
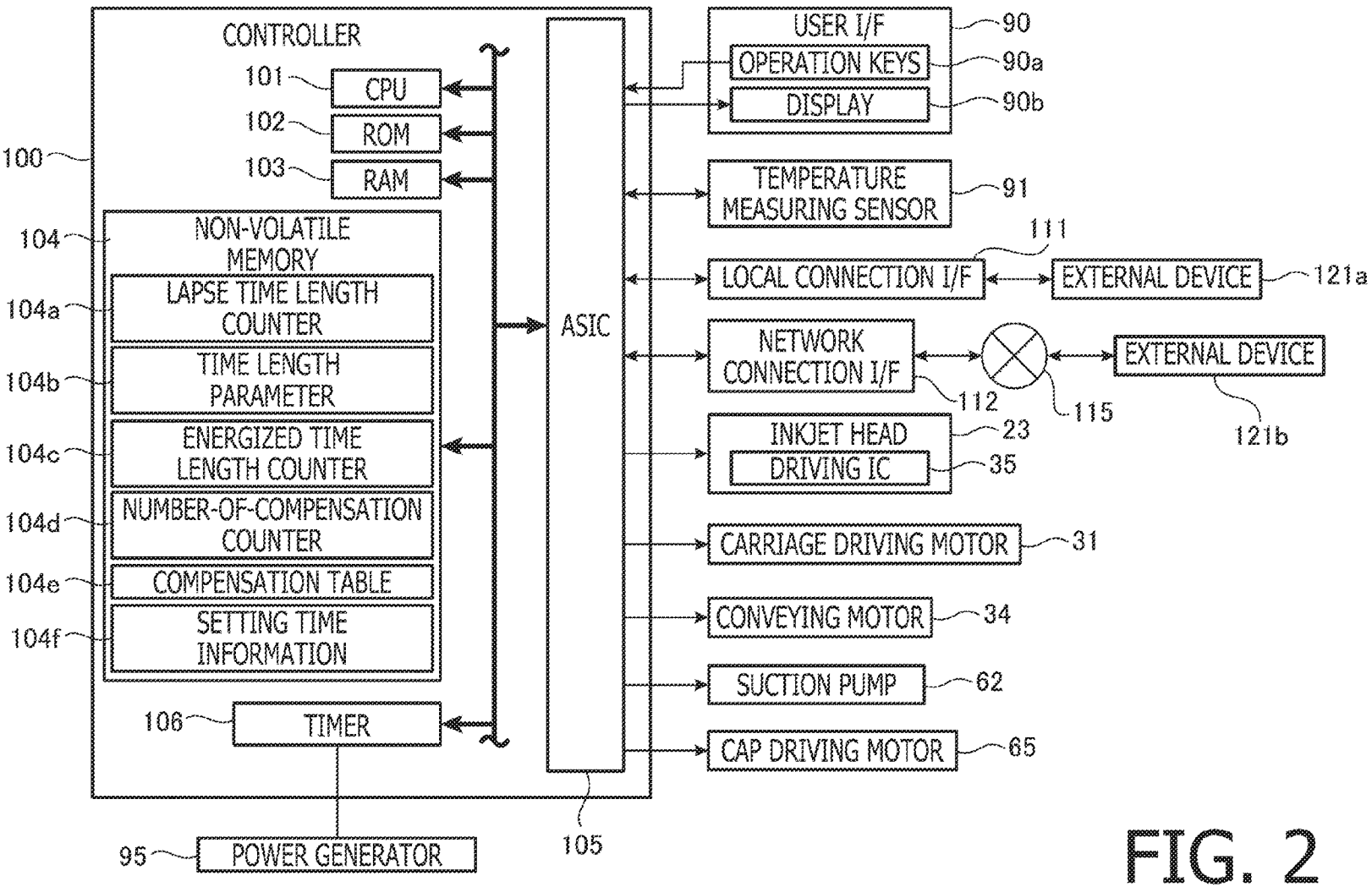
FIG. 2 shows an electrical configuration of the inkjet printer according to the first illustrative embodiment of the disclosures.

The user I/F 90 is an interface for outputting information to users, and for obtaining information from users. According to the illustrative embodiment, as shown in FIG. 2, the user I/F 90 has operation keys 90*a* and a display 90*b*. The operation keys 90*a* are operated by the user and transmit signals to a controller 100. The display 90B displays various pieces of information in accordance with instructions transmitted from the controller 100.

The temperature sensor 91 is a sensor such as a thermistor and is configured to measure ambient temperature, and is configured to transmit a voltage signal corresponding to the ambient temperature to the controller 100. As the controller 100 receives the voltage signal from the temperature sensor 91, the controller 100 can obtain atmospheric temperature data which represents a parameter having correlation with an atmospheric temperature. It is noted that, if the temperature sensor 91 is configured to directly measure the atmospheric temperature, the controller 100 may obtain the atmospheric temperature itself as the atmospheric temperature data.

The power generator 95 is a circuit to receive electrical power from a commercial power supply (not shown). Specifically, the power generator 95 has a power plug, which is to be inserted in an electrical outlet connected to the commercial power supply, to receive the electrical power from the commercial power supply. Further, the power generator 95 is configured to convert the electrical power received from the commercial power supply to appropriate voltages, and supply the converted voltages to respective components in the printer 1.

As shown in FIG. 2, the controller 100 has a CPU 101, a ROM 102, a RAM 103, a non-volatile memory 104, ASIC 105 implemented with various control circuits, a timer 106, and the like. The controller 100 is electrically connected with inkjet head 23, the carriage driving motor 31, the conveying motor 34, the suction pump 62, the user I/F 90 and the like.

It is also noted that the controller 100 is connected with a local connection I/F 111 and a network connection I/F 112. The local connection I/F 111 is an interface to realize a local connection (i.e., a direct connection) with a peripheral device in accordance with a USB standard or an IEEE1394 standard. The controller 100 is capable of receiving image data subject to printing and instructions such as one instructing printing of the received image data received from the external device 121*a* which may be an information processing device such as a PC (personal computer) through the local connection I/F 111. The network connection I/F 112 is an interface to realize a network connection with the external device 121*b* which may be an information processing device such as a PC (personal computer) through the Internet. The controller 110 is also capable of receiving, through the network connection I/F 112, image data subject to printing and instructions such as one instructing printing of the received image data received from the external device 121*b*.

In the ROM 102, programs to be executed by the CPU 101, various types of fixed data and the like are stored. The RAM 103 temporarily stores data (e.g. image data) which is necessary when the CPU 101 executes the programs. The non-volatile memory 104 stores a lapse time length counter 104*a*, an energized time length counter 104*c*, time length parameters 104*b*, a number-of-compensation counter 104*d*, a compensation table 104*e*, setting time information 104*f* and the like.

The timer 106 includes, for example, a RTC (real time clock) and has functions of an internal clock serves to measure the time and a timer serves to measure a lapse of time. The timer 106 operates as the electrical power is supplied from the power generator 95. The current time measured by the timer 106 is compensated in accordance with the time information obtained from an NTP (network time protocol) server which is on the Internet, or the external device 121*b* connected to the NTP server.

The CPU 101 executes the programs stored in the ROM 102 to control operations of the image recorder 2, the maintenance device 6 and the like, via the ASIC 105. It is noted that, in the following description, a case where one CPU executes an image recording operation and the like will be described. It is noted, however, the controller 100 may be provided with multiple CPU's which share operations to be controlled. Optionally or alternatively, the controller 100 may be provided with multiple ASIC's which share and control the operations. Alternatively, a single ASIC may control all the operations.

The CPU 101 executes a following process regarding printing on the recording sheet P. When the CPU 101 receives an instruction to print an image from the external device 121*a* or 121*b* (hereinafter, simply referred to as the external device 121 if the external devices 121*a* and 121*b* need not be discriminated), or receives such an instruction through the user I/F 90, the CPU 101 controls the conveying motor 34, in the image recorder 2, to convey the recording sheet P in the conveying direction. Further, the CPU 101 controls the carriage driving motor 31 of the image recorder 2 to move the inkjet head 23 in the scanning direction, while the CPU 101 controls the inkjet head 23 to discharge the ink (i.e., ink droplets) toward the recording sheet P.

Further, the CPU 101 controls the suction pump 62 to automatically execute the suction purge for maintaining/recovering discharge characteristics of the inkjet head 23. In the non-volatile memory 104, the lapse time length counter 104*a* for counting the lapse time length (i.e., the count value of the lapse time length counter 104*a*) from the point of time when the previous suction purge was executed. The CPU 101 increments the lapse time length count value (hereinafter, simply referred to as the count value) of the lapse time length counter 104*a* based on the time period measured by the timer 106 from the pint of time when the previous suction purge was executed. That is, the count value of the lapse time length counter 104*a* represents the lapse time length, which is calculated, by the CPU 101, based on the time period measure by the timer 106 since the point of time when the previous suction purge was executed. When the CPU 101 determines that the count value of the lapse time length counter 104*a* has reached a particular time (hereinafter, referred to as a maintenance time period), the CPU 101 executes the suction purge. According to this configuration, the suction purge is periodically executed at every lapse of the maintenance time period (e.g., thirty days).

When the power generator 95 is in a state where the electrical power is not received from the commercial power supply (e.g., when the power plug is removed from the electrical outlet), the timer 106 is in a non-energized state, where the timer 106 does not receive the driving electrical power from the power generator 95. When in the non-energized state, the timer 106 cannot measure the current time or a lapse time. Therefore, even if the power generator 95 will receive the electrical power from the commercial power supply and the timer 106 becomes in the energized state as it receives the driving electrical power from the power generator 95 thereafter, the current time measured by the timer 106 will be inaccurate. Further, the count value of the lapse time length counter 104*a* will become shorter than the actual lapse time length by the amount corresponding to the non-energized time length which is the time period when the timer 106 has been in the non-energized state.

It is noted that, when the controller 100 is connected to the NTP server or the external device 121*b* through the network connection I/F 112, or the external device 121*a* through the local connection I/F 111, the controller 100 is capable of obtaining the time information when the controller 100 receives instructions (e.g., the print instruction) from the NTP server, the external device 121*b* or the external device 121*a*. Then, based on the obtained time information, the controller 100 is capable of compensating the current time measured by the timer 106, and the count value of the lapse time length counter 104*a* can also be compensated by the controller 100.

It is noted that there could be a case where the printer 1 is used as a stand-alone device, which is not connected to the NTP server or the external device 121. In such a case, the current time measured by the timer 106 cannot be compensated. Further, the count value of the lapse tie length counter 104*a* cannot be compensated either. Therefore, necessity of the suction purge based on the count value of the lapse time length counter 104*a* cannot be determined appropriately.

In order to avoid the above situation, according to the first illustrative embodiment, the non-energized time length (when the timer 106 is in the non-energized state) is estimated from the energized time length when the timer 106 is in the energized state. Then, based on the estimated non-energized time length, the count value of the lapse time length counter 104*a* is compensated.

There is a case where a certain tendency in user's usage of the printer 1 (hereinafter, referred to as a user's usage tendency) in terms of a time slot within which the user inserts the power plug in the electrical outlet, a time period (i.e., a time length) during which the power plug is kept inserted in the electrical outlet, a time slot within which the user removes the power plug from the electrical outlet and/or a time period (i.e., a time length) during which the power plug is kept removed from the electrical outlet.

Figure 3A:
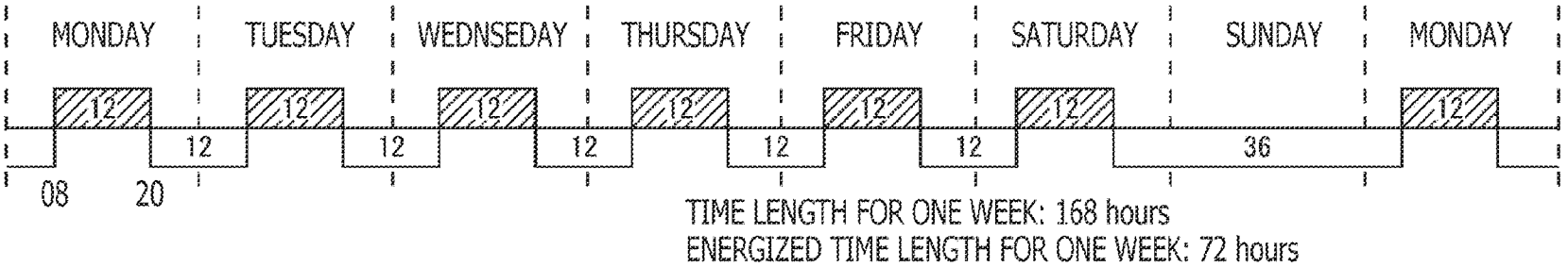
FIG. 3A shows power receiving tendency of a timer according to the first illustrative embodiment of the disclosures.

For example, FIG. 3A shows an example of the user's usage tendency when the printer 1 is used as an office printer. In this example, the power plug of the printer 1 is inserted in the electrical outlet during business hours (e.g., from 8 o'clock to 20 o'clock) on weekdays (e.g., from Monday to Friday). Thus, the timer 106 is in the energized state from 8 o'clock to 20 o'clock on weekdays, while in the non-energized state from 0 o'clock to 8 o'clock, from 20 o'clock to 24 o'clock on weekdays and from 0 o'clock to 24 o'clock on holidays (e.g., during weekend: on Saturday and Sunday). Thus, the driving electrical power the timer 106 receives from the power generator 95 exhibits the power receiving tendency corresponding to the user's usage tendency.

As an example, FIG. 3A shows the power receiving tendency of the timer 106 as follows. The energized/non-energized states of the timer 106 change one to the other in every 12 hours. Further, after changes from the energized state to the non-energized state by six times, the sixth non-energized state of the timer 106 is maintained for 36 hours.

In consideration of the power receiving tendency of the timer 106 above, using the energized time length of the timer 106, the count value of the lapse time length counter 104*a* could be compensated in accordance with a compensation method described below.

Figure 3B:
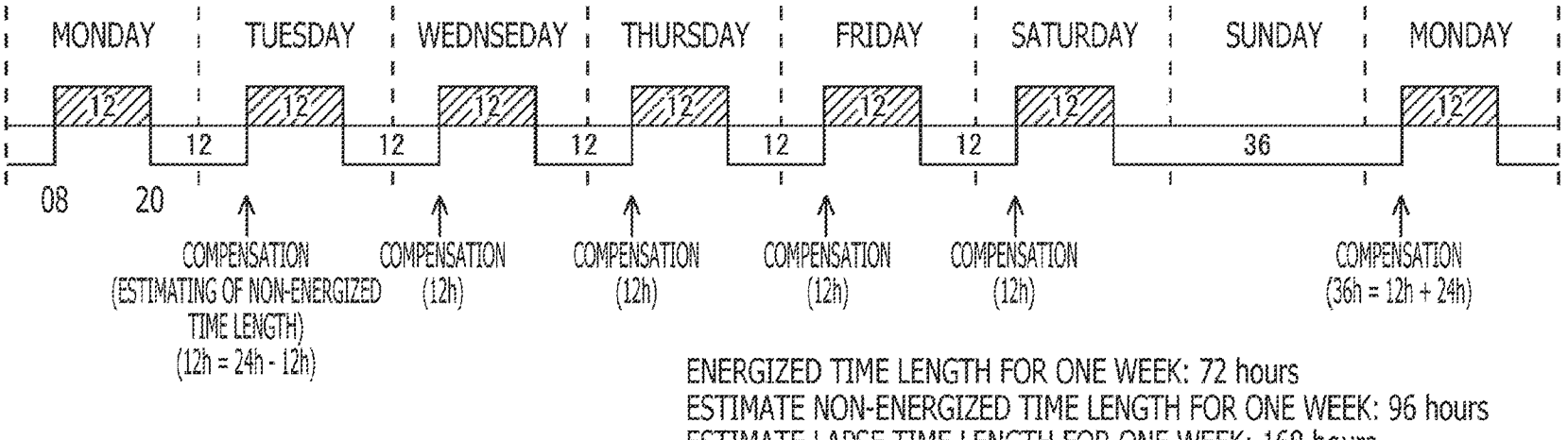
FIG. 3B shows correction of a lapse time length counter.

Firstly, at each point of time where the state of the timer 106 changes from the non-energized state to the energized state, as shown in FIG. 3B, a time length calculated by subtracting the energized time length in the previous energized state from 24 (hours) is regarded as an estimated non-energized time length in the non-energized state immediately before the state of the timer 106 has changed to the current energized state.

Then, the estimated non-energized time length is added to the count value of the lapse time length counter 104*a*. Further, at every sixth change of the state of the timer 106 from the non-energized state to the energized state, 24 (hours) is added to the count value of the lapse time length counter 104*a*.

According to the above compensation method, even if there is variability among energized time lengths of the timer 106 on weekdays, it is possible to make the count value of the lapse time length counter 104*a* equal to the actual lapse time lengths.

It should be noted that the user may user the printer 1 in a different way from the above-described user's usage tendency. According to the user's usage tendency shown in FIG. 3A, on each of the weekdays, the user inserts the power plug in the electrical outlet once, and removes the power plug from the electrical outlet once, too.

Figure 4A:
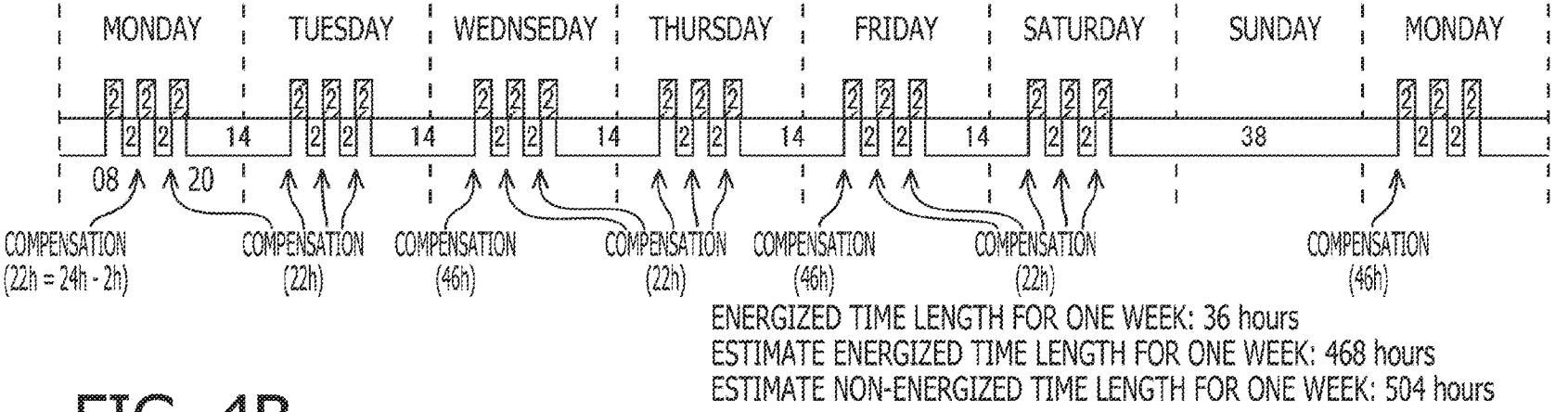
FIG. 4A shows correction of a lapse time length counter according to a comparative embodiment.

FIG. 4A shows another way the user inserts/removes the power plug with respect to the electrical outlet. As in a case shown in FIG. 4A, the user may insert/remove the power plug with respect to the electrical outlet by a plurality of times during a relatively short time period on a weekday. If the above-described compensation method is applied in such a case, a time length calculated by subtracting the energized time length in the previous energized sate from 24 (hours) is estimated as the non-energized time length, at every time point at which the state of the timer 106 changes from the non-energized state to the energized state, and added to the count value of the lapse time length counter 104*a*. When such compensation is executed, the count value of the lapse time counter 104*a* is excessively longer than an actual lapse time length as noted in FIG. 4A. Then, an execution interval of the suction purge, which is executed based on the count value of the lapse time length counter 104*a*, becomes unnecessarily short, thereby the ink being consumed unnecessarily.

Further, the user's usage tendency shown in FIG. 3A is only an example, and, as a matter of course, different users might have different usage tendencies in a strict sense. Therefore, the method of estimating the non-energized time length by subtracting the previous energized time length from a particular value (e.g., 24 hours) as described above cannot be a method suitable to many unspecified users. As such, it is normally very difficult to estimate the non-energized time length based only on the energized time length measured by the timer 106.

Although the user's usage tendencies are different for respective users, there should exist an approximate usage tendency suitable to majority of users, depending on a usage purpose of the printer 1 (e.g., for office use, for factory use, for shop use, etc.) and/or a country or an area where the printer 1 is placed. Such an approximate usage tendency may be obtained by, for example, market survey.

If the printer 1 is uses as an office printer, an example of the usage tendency may described such that the power plug is inserted in the electrical outlet at least one per day on weekdays, the a sum of an insertion time length (i.e., the accumulated energized time length) during which the power plug is inserted in the electrical outlet in one weekday is not less than six hours. In such an example, the approximate power receiving tendency of the timer 106 may be described such that there is an energized time length during which the timer 106 is in the energized state on a weekday, and the sum of the energized time length for one weekday is six hours or more. Therefore, when a fundamental cycle time length is defined as one day (i.e., 24 hours), a ratio of the energized time length to the fundamental cycle time length is equal to or greater than 0.25 (i.e., 6/24).

When the printer 1 is used in accordance with the above-described approximate usage tendency, it is possible to estimate the non-energized time length based on the energized time length of the timer 106 by a certain degree. For example, when the user uses the printer 1 in accordance with the usage tendency corresponding to the office printer, the non-energized time length can be estimated as described below.

At a time point where the state of the timer 106 has changed from the non-energized state to the energized state, when the sum of the energized time lengths (i.e., the accumulated energized time length) of the timer 106 since a time point where the non-energized time length of the timer 106 was previously estimated is less than six hours, it is determined that 24 hours (i.e., the fundamental cycle time length) has not elapsed since the previous estimate, and the non-energized time length is not estimated at this stage. On the other hand, when the sum of the energized time lengths (i.e., the accumulated energized time length) of the timer 106 since the time point where the non-energized time length of the timer 106 was previously estimated is equal to or more than six hours, it is determined that 24 hours (i.e., the fundamental cycle time length) has elapsed since the previous estimate, and the non-energized time length is estimated at this stage. Then, in the printer 1, the compensation is executed by adding the estimated non-energized time length to the count value of the lapse time length counter 104*a*. By this compensation, the non-energized time length on one weekday can be estimated by a certain degree.

The compensation method will be described in further detail. In the non-volatile memory 104, the energized time length counter 104*c* and a plurality of types of time length parameters 104*c*, which are used to estimate the non-energized time length of the timer 106, are stored as shown in FIG. 2.

The energized time length counter 104*c* is a counter for counting an accumulated energized time length (i.e., the energized time length count value) of the timer 106 from a later one of a time point at which the previous suction purge was executed or a time point at which the non-energized time length of the timer 106 was previously estimated. The CPU 101 increments the energized time length count value (hereinafter, simply referred to as a "count value") of the energized time length counter 104*c* based on the time measured by the timer 106 similar to the count value of the lapse time length counter 104*a*. Accordingly, the count value of the energized time length counter 104*c* indicates the energized time length which is calculated by the CPU 101 bases on the time measured by the energized time length counter 104*c*.

The plurality of time length parameters 104*b* correspond to a plurality of power receiving tendencies of the timer 106, which are different depending to the usage purposes of the printer 1 and/or the countries or areas where the printer 1 is placed and used. The time length parameters 104*b* include a first time value regarding a ratio of the energized time length with respect to the fundamental cycle time length based on cyclic nature of a calendar (e.g., a day, a week, a month, and etc.). The first time value is a threshold value regarding the count value of the energized time length counter 104*c* for determining whether the lapse time after estimation of the previous non-energized time length is less than the fundamental cycle time length at each time point where the state of the timer 106 changes from the non-energized state to the energized state. That is, the first time value is the threshold value regarding the count value of the energized time length counter 104*c* to determine whether the non-energized time length of the timer 106 is to be estimated. If the print 1 is used as the office printer as in the above example, the first time value is six hours.

The time length parameters 104*b* may be stored in the non-volatile memory 104 in advance, for example, when the printer 1 is shipped from a factory, or may be externally obtained through the Internet 115 from, for example, a vendor.

It is noted that the CPU 101 estimates the usage purpose of the printer 1, or the country or the area where the printer 1 is placed based on the settings and the like which are imported, through the user I/F 90, at a time of setting-up of the printer 1, and determines one time length parameter 104*b* to be used in estimating the non-energized time length of the timer 106 from among a plurality of kinds of time length parameters 104*b* based on the estimated result.

In the following description, it is assumed that the time length parameter 104*b* when the printer 1 is used as the office printer is determined to be used as the time length parameter 104*b* to estimate the non-energized time length of the timer 106.

According to the above configuration, at a point of time where the state of the timer 106 is changed from non-energized state to the energized state, the CPU 101 determines whether the count value of the energized time length counter 104*c* is equal to or larger than the first time value (i.e., six hours) of the time length parameter 104*b*.

Figure 4B:
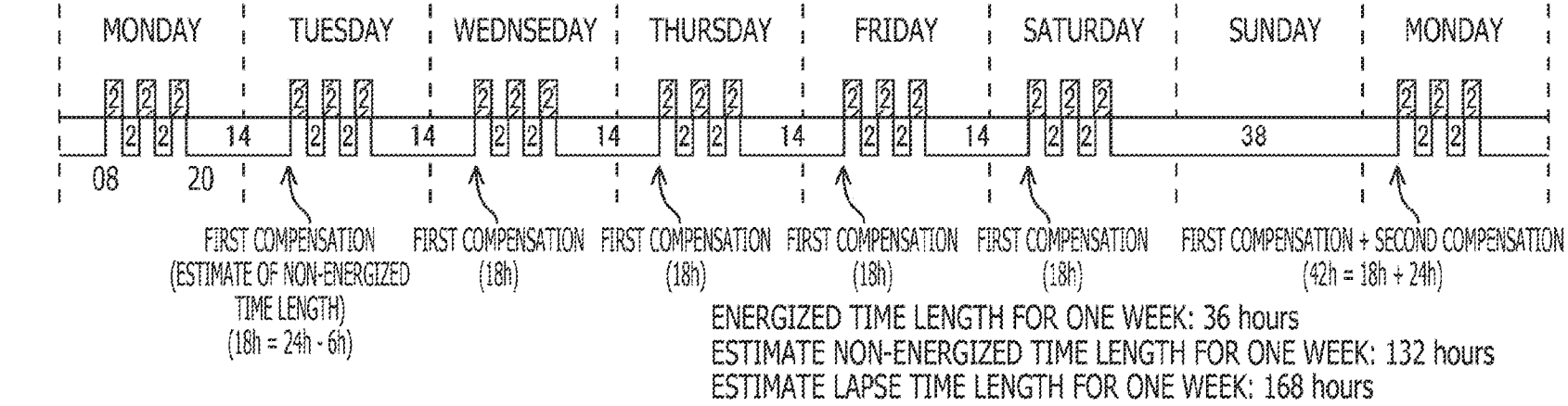
FIG. 4B shows correction of the lapse time length counter according to the first illustrative embodiment of the disclosures.

As shown in FIG. 4B, only when it is determined that the count value of the energized time length counter 104*c* is equal to or larger than six hours, the CPU 101 executes a compensation to add the estimated non-energized time length to the count value of the lapse time length counter 104*a*. Hereinafter, such a compensation may also be referred to as a first compensation.

When it is determined that the count value of the energized time length counter 104*c* is six hours or more, the CPU 101 estimates the non-energized time length with regarding the non-energized time length indicates the value after 24 hours have passed since the previous estimation of the non-energized time length. With this configuration, even if the user performs insertion/removal of the power plug with respect to the electrical outlet by a plurality of time within a relatively short time slot, estimation accuracy of the non-energized time length of the timer 106 can be maintained to be high. Accordingly, it is possible to reduce a difference between the count value of the lapse time length counter 104*a* and the actual lapse time length.

If the business days of the office at which the printer 1 is placed are six days (i.e., weekdays), as shown in FIG. 4B, within a week, the timer 106 has both the energized state and non-energized state on each of the six business days, while the timer 106 stays in the non-energized state all day on each holyday (Sunday). In such a case, if only the first compensation is employed, the one-day length non-energized time length is not added to the count value of the lapse time length counter 104*a*. Therefore, in this case, it is preferable to execute another compensation to add 24 hours to the count value of the lapse time length counter 104*a* at every six estimations of the non-energized time length of the timer 106. Such an additional compensation will also be referred to as a second compensation.

If the business days of the office at which the printer 1 is placed are five days, within a week, the timer 106 has both the energized state and non-energized state on each of the five business days, while the timer 106 stays in the non-energized state all day on the other two days of the week. In such a case, it is preferable to execute the second compensation to add 48 hours to the count value of the lapse time length counter 104*a* at every five executions of the first compensation. If the business days of the office at which the printer 1 is placed are seven days within a week, the timer 106 has both the energized state and non-energized state on each of the seven business days. In such a case, it is unnecessary for the CPU 101 to execute the second compensation.

According to the present embodiment, the non-volatile memory 104 stores the number-of-compensation counter 104*d* and two kinds of compensation tables 104*e*. The number-of-compensation counter 104*d* is for counting the number of the first compensations described above. The compensation table 104*e* is a table defining a set of the number of the first compensations and an additional time to be added to the lapse time length counter 104*a*. The non-volatile memory 104 stores, as the compensation table 104*e*, two kinds of tables: one table in which the number of compensations is six and the additional time is 24 hours, and another table in which the number of compensations is five and the additional time is 48 hours.

The CPU 101 determines, when the user performs the set-up of the printer 1, whether the second compensation is to be executed, and if the second compensation is executed, which of the two kinds of compensation tables 104*e* is to be used, based on the setting input trough the user I/F 90.

Thereafter, when the CPU 101 determines that the second compensation is to be executed, the CPU 101 add one to the count value of the number-of-compensation counter 104*d* every time when the first compensation is executed. When the count value of the number-of-compensation counter 104*d* has reached the number of compensations defined in the compensation table 104*e*, which was determined to be used by the CPU 101, the CPU 101 executes the second compensation of adding the additional time also defined in the compensation table 104*e* to the count value of the lapse time length counter 104*a*. By the above second compensation, as shown in FIG. 4B, even if, on a holiday, the timer 106 is maintained in the non-energized state all day, the time length corresponding to the holiday is added to the count value of the lapse time length counter 104*a*. Therefore, a difference between the count value of the lapse time length counter 104*a* and the actual lapse time length can be made smaller.

In the following description, it is assumed that the CPU 101 has determined to execute the second compensation, and to use the compensation table 104*e* defining the number of compensations is six that the additional time is 24 hours.

Figure 5A:
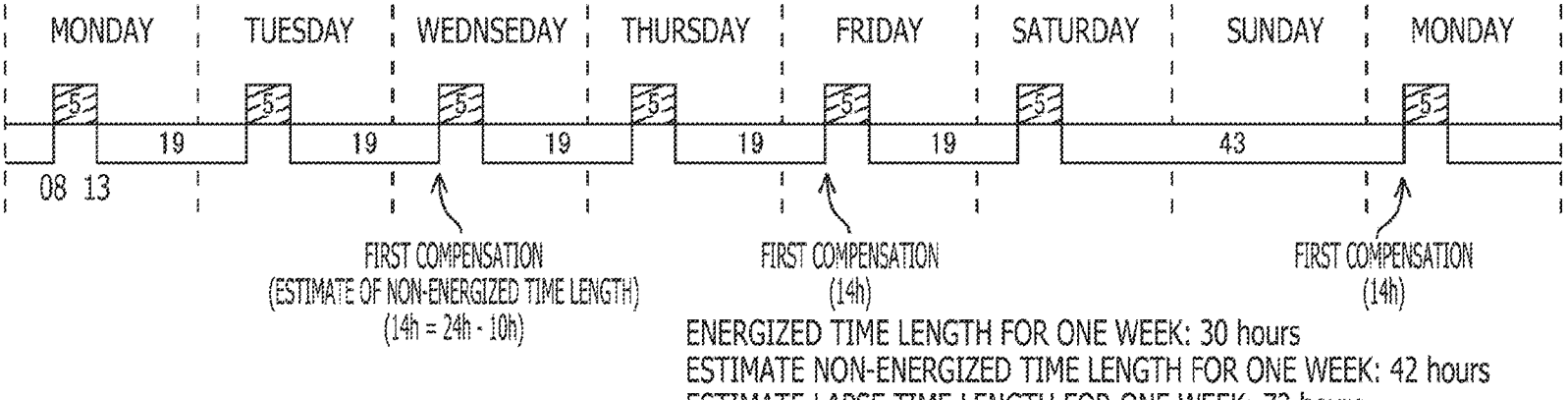
FIGS. 5A and 5B show correction of the lapse time length counter according to the first illustrative embodiment of the disclosures.

According to the first and second compensations described above, when the actual energized time length for one day is less than six hours as shown in FIG. 5A, the count value of the lapse time length counter 104*a* is shorter than the actual lapse time length. However, in comparison with a case, which is different from the illustrative embodiment, where the first and the second compensations are not executed, a difference between the count value of the lapse time counter 104*a* and the actual lapse time can be made smaller.

It is noted that, if the user uses the printer 1 in accordance with the usage tendency which is different from the above-described approximate usage tendency, the estimated non-energized time length will be largely different from the actual non-energized time length. However, the estimation method of the non-energized time length according to the present illustrative embodiment does not assume such a case. That is, in such a case, another estimation method, which is different from the method according to the above-described embodiment, will be employed to estimate the non-energized time length.

Figure 5B:
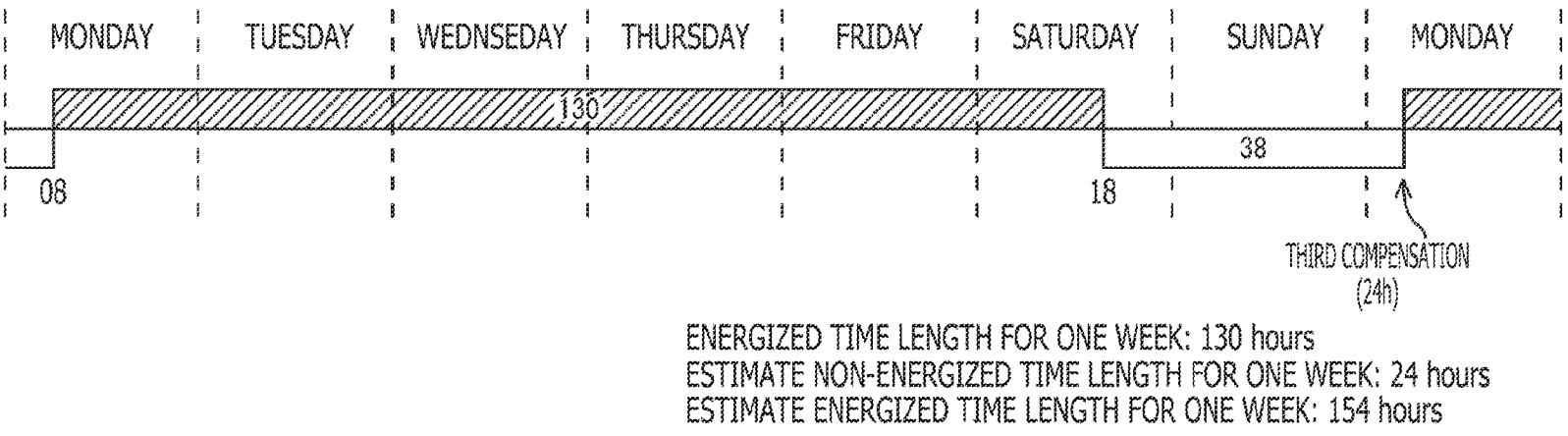

As the approximate usage tendency when the printer 1 is used as the office printer, as shown in FIG. 5B, if the time length of one insertion of the power plug into the electrical outlet is 96 hours or more, and less than 168 hours, the time length of one removal of the same immediately after the above insertion tends to be 24 hours or more. That is, as the approximate power receiving tendency of the timer 106, when the time length of one energized state of the timer 106 is 96 hours or more, and less than 168 hours, the non-energized time length immediately after the above energized state tends to be 24 hours or more.

Thus, according to the illustrative embodiment, in a case where the state of the timer 106 is changed from the non-energized state to the energized state, if the energized time length of the previous energized state of the timer 106 is 96 hours or more, and less than 168 hours, the CPU 101 executes a compensation to add only 24 (hours) to the count value of the lapse time length counter 104*a* (hereinafter, also referred to as a third compensation).

Concretely, the non-volatile memory 104 stores setting time information 104*f* including a second time value indicating 96 (hours), and a third time value indicating the 168 (hours). The CPU 101 executes the third compensation of adding 24 (hours) to the counter value of the lapse time length counter 104*a* if the counter value of the energized time length counter 104*c* is equal to or more than the value indicated by the second time value (i.e., 96 hours) of the set time information 104*f* and less than the time value indicated by the third time value (i.e., 168 hours) when the state of the timer 106 is changed from the non-energized state to the energized state.

According to the above configuration, even when the timer 106 is in the energized state all day on each of the weekdays (i.e., six days) while in the non-energized state all day on a holiday (i.e., one day), a difference between the counter value of the lapse time length counter 104*a* and the actual lapse time length can be made small.

It is noted that, strictly speaking, the count value of the energized time length counter 104*c* does not represent the energized time length of the previous energized state of the timer 106, but the energized time length since the time point where the non-energized time length was estimated previously. Therefore, on consideration that the first time value of the time length parameters 104*b* is six hours, there could be an error of less than six hours between the energized time length of the previous energized state of the timer 106 and the count value of the energized time length counter 104*c*. Therefore, the CPU 101 calculates the energized time lengths of the respective energized states and stores the same in the non-volatile memory 104, in addition to the count value of the energized time length counter 104*c*.

With the configured as above, at the time point where the state of the timer 106 is changed from the non-energized state to the energized state, the CPU 101 may determine whether or not the third compensation is to be executed by comparing the energized time length of the previous energized state with the second and third time values of the set time information 104.

Figure 6:
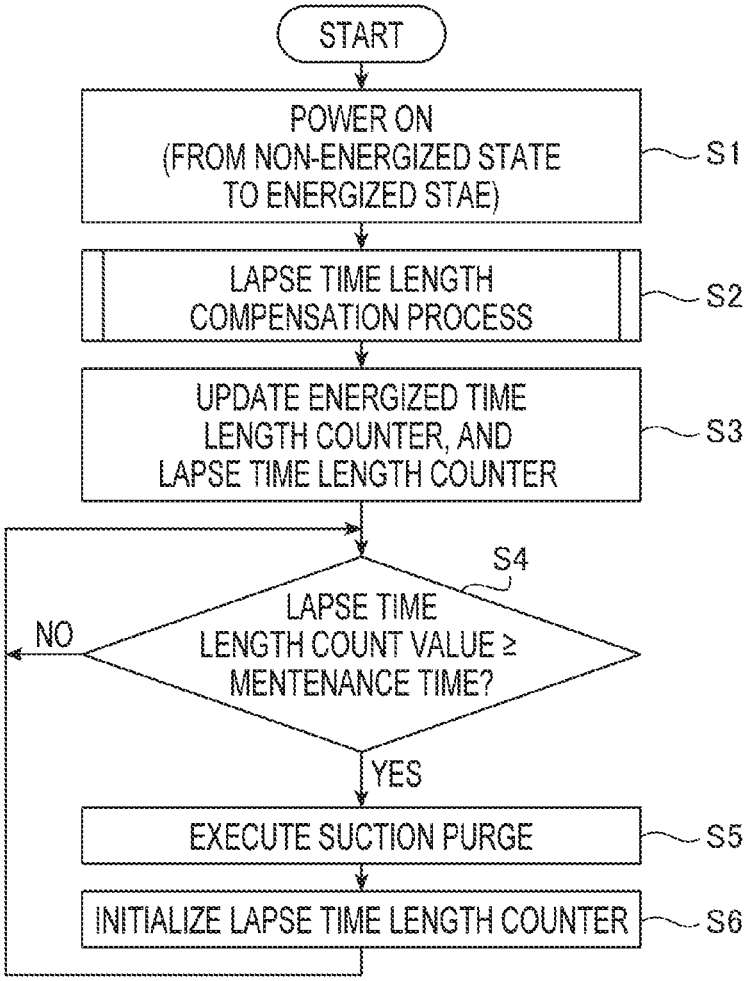
FIG. 6 is a flowchart illustrative a process executed by the inkjet printer according to the first illustrative embodiment of the disclosures.

Next, a process executed by the printer 1 according to the first illustrative embodiment will be described, referring to FIG. 6. It is assumed that the power plug is removed from the electrical outlet at a time point where a flowchart shown in FIG. 6 starts and the timer 106 is in the non-energized state.

Figure 7:
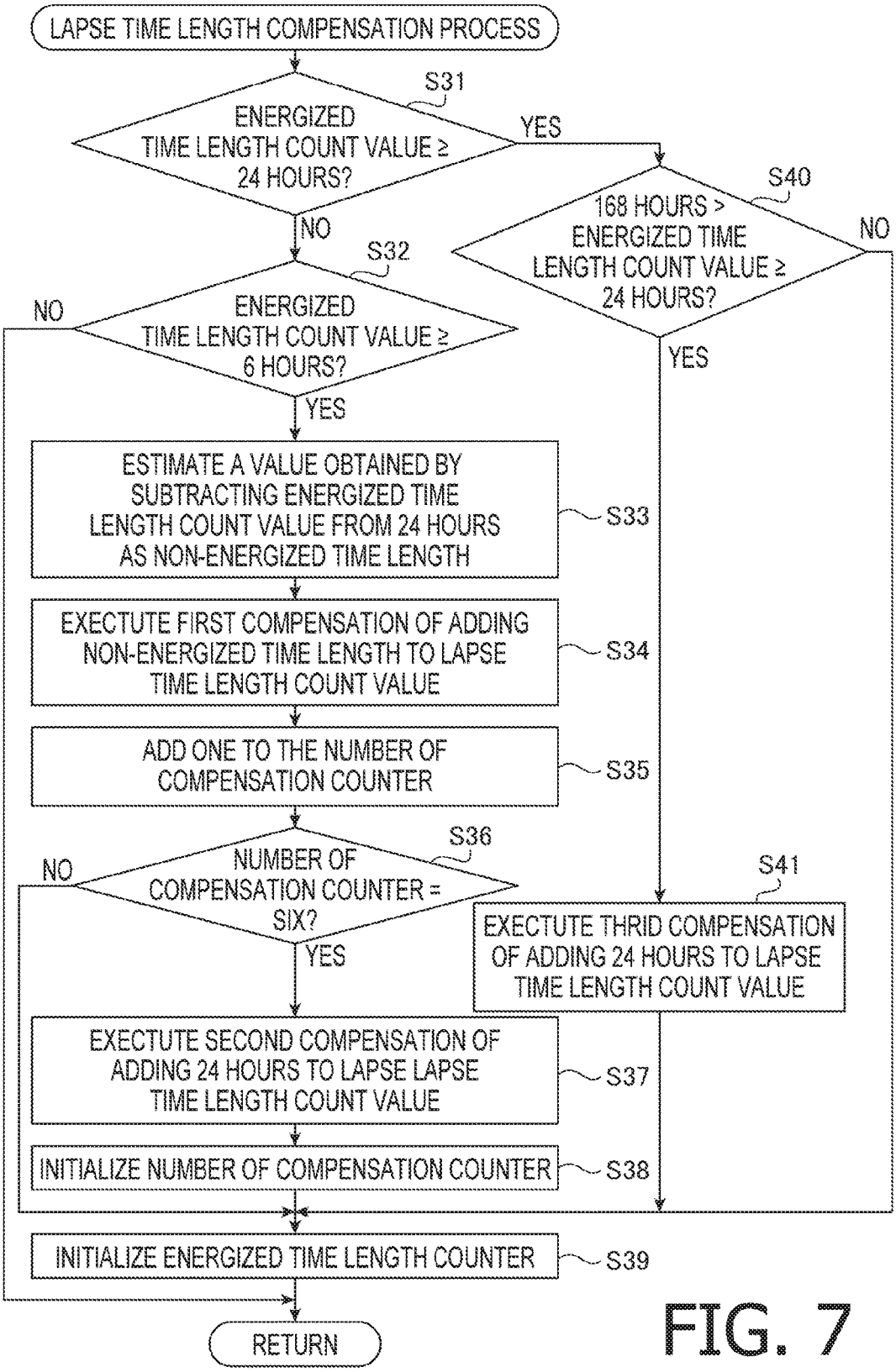
FIG. 7 is a flowchart illustrative a lapse time length compensation process according to the first illustrative embodiment of the disclosures.

Firstly, when the user inserts the power plug in the electrical outlet and the state of the timer 106 is changed from the non-energized state to the energized state (S1), the CPU 101 determines that the timer 106 has experienced the non-energized state and executes a lapse time length compensation process (S2), which will be described, referring to FIG. 7, in detail later. In the lapse time length compensation process, the CPU 101 estimates the non-energized time length when the timer 106 was in the non-energized state, and compensates the count value of the lapse time length counter 104*a*.

Next, the CPU 101 executes an updating process (S3) in which the CPU 101 increments each of the count value of the energized time length counter 104*c* and the count value of the lapse time counter 104*a* based on the time length measured by the timer 106. It is noted that the above-described process of incrementing each of the count value of the energized time length counter 104*c* and the count value of the lapse time counter 104*a* based on the time length measured by the timer 106 will be repeated as far as the timer 106 is in the energized state.

Next, the CPU 101 determines whether the count value of the lapse time counter 104*a* is equal to or larger than the maintenance time (S4). When it is determined that the count value of the lapse time length counter 104*a* is less than the maintenance time (S4: NO), S4 is repeated. When it is determined that the count value of the lapse time length counter 104*a* is equal to the maintenance time or larger (S4: YES), the CPU 101 controls the maintenance device 6 to executes the suction purge (S5). Thereafter, the CPU 101 initializes the lapse time length counter 104*a* (S6), and returns to S4.

Next, a lapse time length compensation process the printer 1 executes will be described, referring to FIG. 7.

Firstly, the CPU 101 determines whether the count value of the energized time length counter 104*c* is 24 (hours) or larger (S31). When it is determined that the counter value of the energized time length counter 104*c* is less than 24 (hours) (S31: NO), the CPU 101 determines whether the count value of the energized time length counter 104*c* is equal to or larger than the first time value (i.e., six hours) of the time length parameters 104*b* (S32). When it is determined that the count value of the energized time length counter 104*c* is less than the first time value (i.e., six hours) (S32: NO), the CPU 101 does not estimate the non-energized time length, determines that the lapse time length counter 104*a* is not compensated, and terminates the present process.

When it is determined that the count value of the energized time length counter 104*c* is equal to or larger than six hours (S32: YES), the CPU 101 estimate the time length calculated by subtracting the count value of the energized time length counter 104*a* from 24 (hours) as the non-energized time length (S33). Then, the CPU 101 executes the first compensation of adding the non-energized time length to the lapse time length counter 104*a* (S34). Thereafter, the CPU 101 increments the number of compensations represented by the number-of-compensation counter 104*d* by one (S35), and determines whether the number of compensations represented by the number-of-compensation counter is the number defined in the compensation table 104*e* (i.e., six) (S36). When it is determined that the number of compensations is not six (S36: NO), the CPU 101 initializes the energized time length counter 104*c* (S39), and terminates the present process.

When it is determined that the number of compensations represented by the number-of-compensation counter 104*d* is the defined number (i.e., six) (S36: YES), the CPU 101 assumes that there is one day during which the timer 106 has been in the non-energized state all day, and executes the second compensation of adding the additional time defined in the compensation table 104*e* (i.e., 24 hours) to the lapse time length counter 104*a* (S37). Thereafter, the CPU 101 initializes the number-of-compensation counter 104*d* (S38), initializes the energized time length counter 104*c*, and terminates the present process.

When it is determined, in S31, that the count value of the energized time length counter 104*c* is equal to or larger than 24 (hours) (S31: YES), the CPU 101 determines whether the count value of the energized time length counter 104*c* is equal to or larger than 96 (hours) and less than 168 (hours) (S40). When it is determined that one of a condition where the energized time length is equal to or larger than 96 (hours) or another condition where the energized time length is less than 168 (hours) is not satisfied (S40: NO), the CPU 101 does not estimate the non-energized time length, determines that the lapse time length counter 104*a* is not to be compensated, initializes the energized time length counter 104*c* (S39), and terminates the present process.

When it is determined that the count value of the energized time length counter 104*c* is equal to or larger than 96 (hours), and less than 168 (hours) (S40: YES), the CPU 101 assumes that there is one day on which the timer 106 has been in the non-energized state all day, and executes the third compensation of adding 24 (hours) to the lapse length counter 104*a* (S41).

According to the first illustrative embodiment, the non-energized time length of the timer 106 can be estimated based on the count value of the energized time length counter 104*c* and the time length parameters 104*b*. Further, by compensating the count value of the lapse time length counter 104*a* based on the estimated non-energized time length, the lapse time length elapsed from the time point where the previous suction purge was executed at a high accuracy, and the maintenance of the inkjet head 23 can be appropriately carried out.

Further, when the count value of the energized time length counter 104*c* is equal to or larger than the first time value of the time length parameters 104*b* (i.e., six hours) at each time point where the state of the timer 106 is changed from the non-energized state to the energized state, the non-energized time length is estimated and the count value of the lapse time length counter 104*a* is compensated, the difference between the count value of the lapse time length counter 104*a* and the actual lapse time length can always be made small.

Second Illustrative Embodiment

Next, referring to FIGS. 8-10B, a second illustrative embodiment will be described. It is noted that, in the following description, different portions with respect to the first illustrative embodiment will mainly be described.

When the time information can be obtained from an external device 121 even after the timer 106 is in the non-energized state, it is possible to compensate the lapse time length counter 104*a* based on the thus obtained time information.

Figure 8:
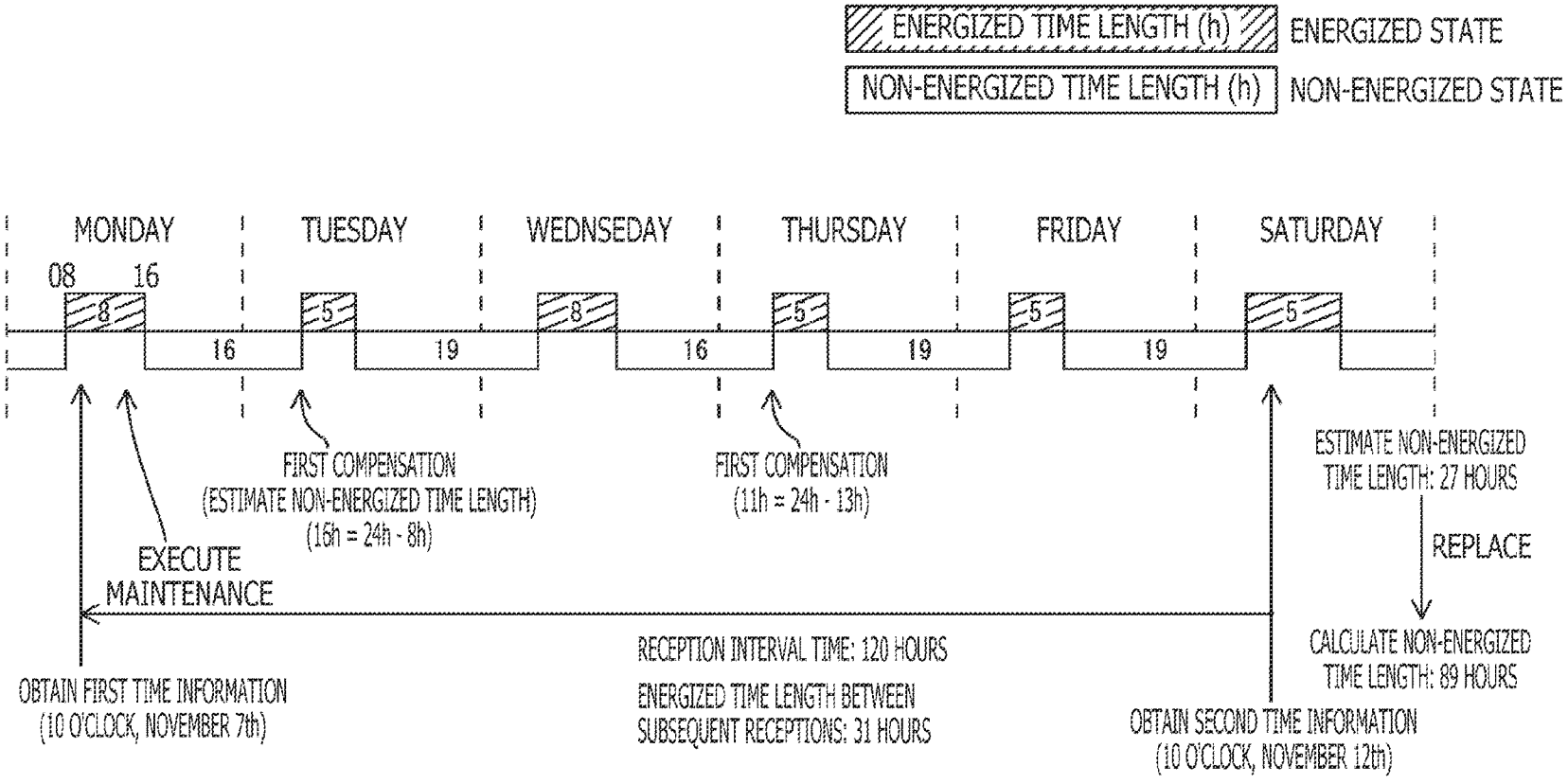
FIG. 8 shows correction of the lapse time length counter according to a second illustrative embodiment of the disclosures.

For example, as shown in FIG. 8, when first time information is received from the external device 121 before the timer 106 became in the non-energized state, and second time information is received from the external device 121 after the state of the timer 106 became in the non-energized state, it is possible to calculate a lapse time (hereinafter, referred to as a "reception interval length") from the time point at which the first time information was received to the time point at which the second time information was received.

Therefore, by calculating the energized time length of the timer 106 from the time point where the first time information was received to the time point where the second time information was received based on the time measure by the timer 106, a sum of the non-energized time lengths existing between the time point at which the first time information was received to the time point at which the second time information was received can be calculated with high accuracy.

As above, it is likely that the non-energized time length calculated based on the time information obtained from the external device 121 has a higher accuracy than the non-energized time length estimated based on the energized time length of the timer 106. Therefore, according to the second illustrative embodiment, in the count value of the lapse time length counter 104*a*, the sum of the time lengths added by the first through third compensations in relation to the non-energized state is replaced with the non-energized time length calculated based on the first time information and the second time information when there is a non-energized state between the time point where the first time information was received from the external device 121 and the time point where the second time information was received from the external device 121. With the above configuration, it is possible to reduce a difference between the count value of the lapse time length counter 104*a* and the actual lapse time length.

Figure 9:
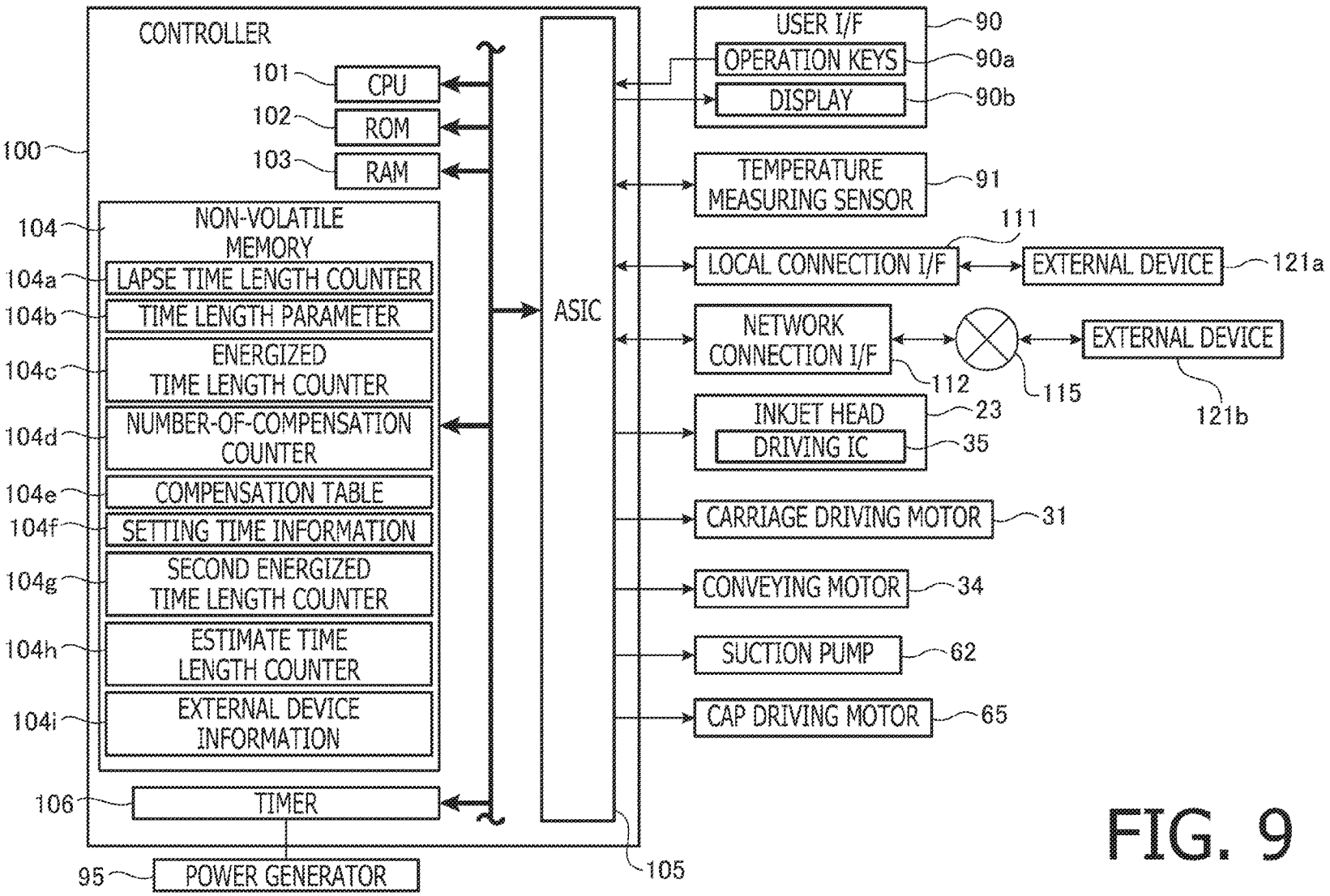
FIG. 9 shows an electrical configuration of the inkjet printer according to the second illustrative embodiment of the disclosures.

As shown in FIG. 9, the non-volatile memory 104 is configured to further store second energized time length counter 104*g*, and an estimate time length counter 104*h*. The second energized time length counter 104*g* is a counter for counting an accumulated time length (i.e., a second energized time length count value) of the timer 106 from the time point at which the time information was previously received from the external device 121. The CPU 101 is configured to increment the second energized time length count value (hereinafter, simply referred to as a "count value") of the energized time length counter 104*g* based on the time measured by the timer 106. Thus, the second energized time length count value of the energized time length counter 104*g* indicates the energized time length calculated by the CPU 101 based on the time measured by the timer 106.

The estimate time length counter 104*h* is a counter for counting the sum of the time lengths added to the count value of the lapse time length counter 104*a* by the first, second and third compensations, after the above-described time point at which the time information was received from the external device 121.

At each time point where the time information is received from the external device 121, the CPU 101 determines whether there is a non-energized state of the timer 106 between the time point where the time information was previously received and the time point where the current time information has been received. When it is determined that there exists the non-energized state, the CPU 101 calculates the reception interval length between the time indicated by the time information currently received and the time indicated by the time information previously received. Then, the CPU 101 calculate a time length, as the non-energized time length, by subtracting the count value of the second energized time length counter 104*g* from the calculated reception interval length. Thereafter, the CPU 101 adds the calculated non-energized time length to the count value of the lapse time counter 104*a*, and applies a compensation to subtract the count value of the estimate time length counter 104*h* from count value of the lapse time length counter 104*a*. As a result, it is possible to reduce a difference between the count value of the lapse time length counter 104*a* and the actual lapse time length.

As mentioned before, regarding the non-energized time length of the timer 106, it is likely that the value calculated based on the time information obtained from the external device is more accurate than the value estimated based on the energized time length of the timer 106.

Therefore, if the non-energized time lengths of all the non-energized states between the time point where the previous suction purge was executed to the current time point can be calculated based on the time information obtained from the external device 121, the difference between the count value of the lapse time length counter 104*a* (hereinafter, referred to as a measured lapse time length count value) and the actual lapse time length is small.

However, there is a case where the non-energized time length cannot be calculated based on the time information. For example, after the time point where the state of the timer 106 is changed from the non-energized sate to the energized state, and before the time information is newly received from the external device 121, the non-energized time length of the non-energized state immediately before the state has been changed to the current energized state cannot be calculated based on the time information. Further, if the time information is not received from the external device 121 in the energized state for previous suction purge, the non-energized time length of the non-energized state between the time point where the previous suction purge was executed to the time point where the time information is received thereafter cannot be calculated.

As described above, in regard with any of the non-energized states existing from the time point where the previous suction purge was executed to the current time point, when it is necessary to estimate the non-energized time length based on the energized time length of the timer 106, there is a possibility that a difference between the count value of the lapse time length counter 104*a* (hereinafter, referred to as an estimate lapse time length count value) and the actual lapse time length is high.

Then, if the suction purge is executed according to the same control sequence regardless whether the count value of the lapse time length counter 104*a* is the measured lapse time length count value or the estimate lapse time length count value, there is a possibility that the discharge characteristic of the inkjet head 23 cannot be recovered or the ink is unnecessarily consumed.

When the lapse time length count value of the lapse time length counter 104*a* is the measured lapse time length count value, the CPU 101 controls the maintenance device 6 in accordance with the first control sequence, while, when the lapse time length count value is the estimate lapse time length count value, the CPU 101 controls the maintenance device 6 in accordance with a second control sequence which is different from the first control sequence.

According to the first sequence, the CPU 101 executes the suction purge when the count value of the lapse time length counter 104*a* has reached the first maintenance time. According to the second sequence, the CPU 101 executes the suction purge when the count value of the lapse time length counter 104*a* has reached the second maintenance time, which is shorter than the first maintenance time. Further, in the suction purge executed in accordance with the second control sequence (hereinafter, referred to a third purge), the amount of the ink discharged from the nozzles 30 is larger in comparison with the suction purge according to the first control sequence (e.g., a first purge and a second purge, which will be described later). With this configuration, even if the estimate lapse time length count value of the lapse time length counter 104*a* is shorter than the actual lapse time, it is ensured that the discharge characteristic of the inkjet head 23 is recovered.

As described above, by differentiating the control sequences depending on whether the count value of the lapse time length counter 104*a* is the measured lapse time length count value or the estimate lapse time length count value, it is possible to suppress unnecessary consumption of the ink can be suppressed with recovering the ink discharging characteristic of the inkjet head 23.

It is noted that there could be a case where the time indicated by the time information transmitted from the external device 121 is different from the actual time. For example, the external device 121*a* connected to the local connection I/F 111 is note connected to the Internet, an internal clock may not indicate the time accurately. As a result of inaccuracy of the internal clock, the reception interval length which is calculated based on the first time information received from the external device 121 before the non-energized state, and the second time information received from the external device 121 after the non-energized state may be different from the actual lapse time length from the time point where the first time information was received and the time point where the second time information was received. In such a case, since the difference between the count value of the lapse time length counter 104*a* and the actual lapse time length is relatively large, even if the maintenance device 6 is controlled in accordance with the first control sequence, the suction purge may not be executed at an appropriate timing, or an appropriate amount of ink cannot be discharged from the nozzles 30 in the suction purge.

According to the second illustrative embodiment, reliability of the reception interval length calculated from the time indicated by the first time information and the time indicated by the second time information is determined, and the maintenance device 6 is controlled in accordance with different first control sequences depending on the reliability. Specifically, every time when the time information is obtained from the external device 121, the CPU 101 obtains, from the external device 121, identification information identifying the external device 121, and network connection information indicating presence/absence of connection of the external device 121 to the Internet 115, generates external device information 104*i* including the above information, and stores the same in the non-volatile memory 104. Then, the CPU 101 refers to the external device information 104*i* related to the second time information which is the time information currently obtained, and the external device information 104*i* related to the first time information which is the time information previously obtained, to determine the reliability of the reception interval length in two stages of high or low.

Specifically, when a transmission source of the first time information and a transmission source of the second time information are the same external device 121, even if the internal clock of the external device 121 is inaccurate and the times indicated in the first time information and the second time information are slightly shifted with respect to the actual time, it is likely that the shifted amounts are substantially the same. Therefore, when it is determined that the transmission source of the first time information and the transmission source of the second time information are the same external device 121, the CPU 101 determines that the reliability of the reception interval length is high. Further, when it is determined, based on network connection presence/absence information, that the transmission source of the first time information and the transmission source of the second time information are the external devices 121 both connected to the Internet 115, it is likely that the reception time information is accurate since it is calculated based on the accurate time information, the CPU 101 determines that the reliability of the reception interval length is high. In contrast, when the transmission source of the first time information and the transmission source of the second time information are different external devices 121, and at least one of the two different external devices 121 is not connected to the Internet 115, the CPU 101 determines that the reliability of the reception interval length is low.

It is noted that, in order to control the maintenance device 6, a high-reliability sequence, which is executed when the reliability of the reception interval length is determined to be high, and a low-reliability sequence, which is executed when the reliability of the reception interval length is determined to be low, are stored in the ROM 102. It is noted that the execution interval of the low-reliability sequence and the execution interval of the high-reliability sequence are the same. However, the suction purge executed in the low-reliability sequence (hereinafter, referred to as a second purge) and the suction purge executed in the high-reliability sequence (hereinafter, referred to as a first purge) are different in that the amount of the ink discharged from the nozzles 30 is larger in the second purge than in the first purge. It is also noted that, according to the present embodiment, the first purge is the same as the suction purge which is executed when the energized state of the timer 106, after execution of the previous suction purge, has been maintained.

According to the above configuration, the CPU 101 selects the low-reliability sequence of the high-reliability sequence as the first control sequence to be executed based on the reliability of the reception interval length, and controls the maintenance device 6 in accordance with the selected first control sequence. According to the above-described control, it is possible to suppress unnecessary consumption of the ink with recovering the discharge characteristic of the inkjet head 23.

Figure 10A:
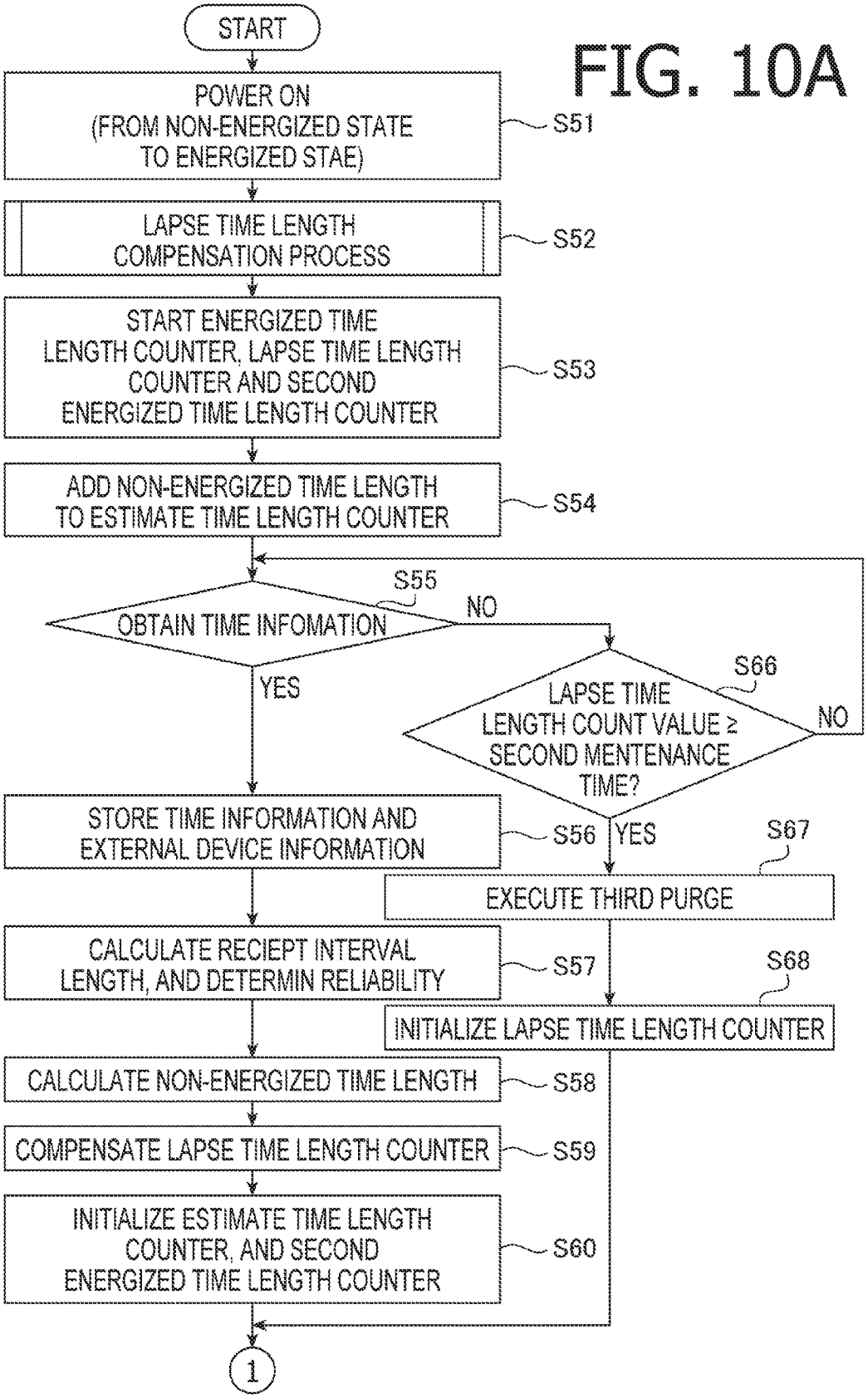
FIGS. 10A and 10B show a flowchart illustrating a process executed by the inkjet printer according to the second illustrative embodiment.
Figure 10B:
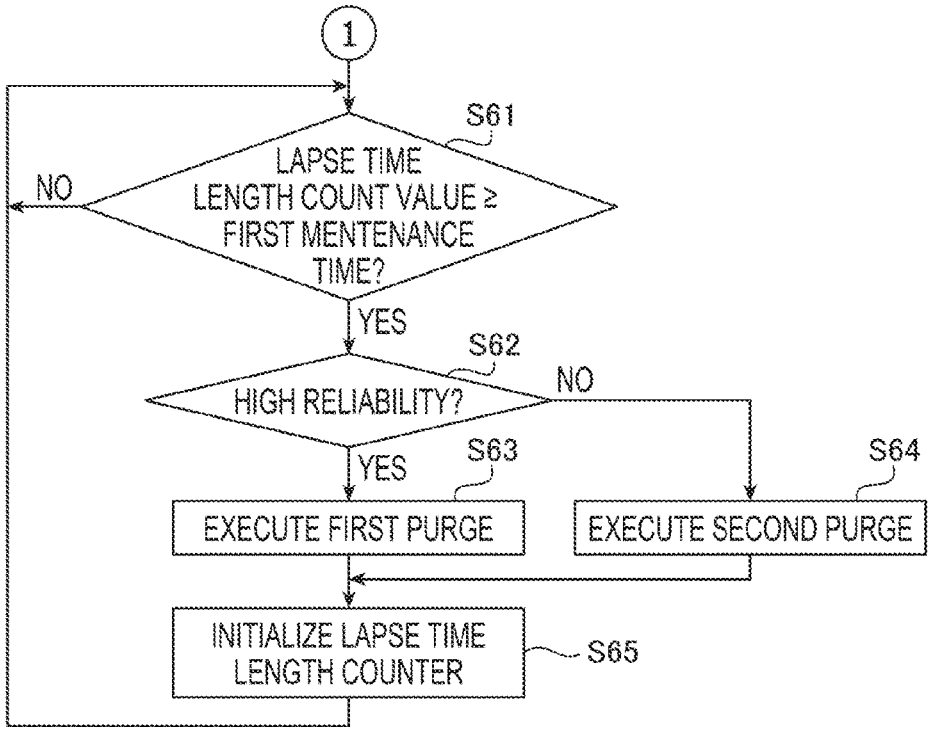

Hereinafter, a process executed by the printer 1 according to the second illustrative embodiment will be described, referring to FIGS. 10A and 10B. It is assumed that, when the process shown in FIGS. 10A and 10B is started, the power plug is removed from the electrical outlet and the timer 106 is in the non-energized state. It is also assumed that the printer 1 has received the time information from the external device 121 when the timer 106 was in the energized state and the previous suction purge was executed as shown in FIG. 8.

When the user inserts the power plug in the electrical outlet, and the state of the timer 106 is changed from the non-energized state to the energized state (S51), the CPU 101 determined that the timer 106 has experienced the non-energized state, and executes the lapse time length compensation process, which is described above with reference to FIG. 7 (S52). It is noted that the count value of the lapse time length counter 104*a* after execution of S52 is the estimated lapse time length count value described above.

Next, the CPU 101 executes the updating process (S53) in which the CPU 101 updates (i.e., increments) the count value of the energized time length counter 104*c*, the count value of the lapse time length counter 104*a* and the second energized time length count value of the second energized time length counter 104*g*, based on the time measured by the timer 106. The updating process to update the energized time length counter 104*b*, the lapse time length counter 104*a* and the second energized time length counter 104*g* based on the time measured by the timer 106 is repeatedly executed when the timer 106 is in the energized state.

Then, the CPU 101 adds the non-energized time length, which was added to the lapse time length counter 104*a* in S52, to the count value of the estimate time length counter 104*h* (S54). Next, the CPU 101 determines whether the time information is obtained from the external device 121 (S55). When it is determined that the time information has been obtained (S55: YES), the CPU 101 generates the external device information 104*i* regarding the time information, and stores the thus generated external device information 104*i* and the obtained time information in the non-volatile memory 104 (S56). Thereafter, the CPU 101 calculates the reception interval length based on the time information obtained in S55 and the time information previously obtained from the external device 121, and determines the reliability of the calculated reception interval length in two stages of high or low, referring to the external device information 104*i* (S57).

Next, the CPU 101 subtracts the count value of the second energized time length counter 104*g* from the reception interval length calculated in S57 to obtain the non-energized time length (S58). Then, the CPU 101 subtracts the count value of the estimate time length counter 104*h* from the count value of the lapse time length counter 104*a*, and adds the non-energized time length obtained in S58 to compensate the lapse time length counter 104*a* (S59). By the above-described calculation, the count value of the lapse time length counter 104*a* is the measured lapse time length counter. Next, the CPU 101 initializes the second energized time length counter 104*g* and the estimate time length counter 104*h* (S60).

In S61, the CPU 101 determines whether the count value of the lapse time length counter 104*a* is equal to or larger than the first maintenance time. When it is determined that the count value of the lapse time length counter 104*a* is less than the first maintenance time (S61: NO), the CPU 101 repeats S61. When it is determined that the count value of the lapse time length counter 104*a* is equal to or larger than the first maintenance time (S61: YES), the CPU 101 determines whether the reliability of the reception interval length which has been examined in S57 is the high or low (S62).

It is noted that, after the state of the timer 106 was changed for the non-energized state to the energized state in S51, if the suction purge has been executed at least one, since the state of the timer 106 has not been changed to the non-energized state from the time point where the previous suction purge was executed to the current time point, the CPU 101 assumes that the reliability of the reception interval length is high regardless of the result of determination in S57.

When it is determined that the reliability of the reception interval length is high (S62: YES), the CPU 101 controls the maintenance device 6 to execute the first purge (S63). When it is determined that the reliability of the reception interval length is low (S62: NO), the CPU 101 controls the maintenance device 6 to execute the second purge (S64). After execution of S63 or S64, the CPU 101 initializes the lapse time length counter 104*a* (S65), and returns to S61.

When it is determined that the time information has not been obtained from the external device 121 (S55: NO), the CPU 101 determines whether the count value of the lapse time length counter 104*a* is equal to or larger than the second maintenance time (S66). When it is determined that the count value of the lapse time length counter 104*a* is less than the second maintenance time (S66: NO), the CPU 101 returns to S55. When it is determined that the count value of the lapse time length counter 104*a* is equal to or larger than the second maintenance time (S66: YES), the CPU 101 control the maintenance device 6 to execute the third purge (S67). Thereafter, the CPU 101 initializes the lapse time length counter 104*a* (S68), and returns to S61.

As described above, according to the second illustrative embodiment, when the time information has been received from the external device 121 immediately before and after the timer 106 is in the non-energized state, it is possible to make a difference between the count value of the lapse time length counter 104*a* and the actual lapse time length considerably small by calculating the non-energized time length based on the received time information. When the time information was not received at least immediately before or after the non-energized state of the timer 106, it is possible to make a difference between the count value of the lapse time length counter 104*a* and the actual lapse time length small by estimating the non-energized time length based on the energized time length of the timer 106, which is obtained inside the printer 1. As above, according to the second illustrative embodiment, the lapse time length elapsed from execution of the previous suction purge can be calculated with high accuracy.

In the above-described embodiments, the power source circuit 96 is an example of the power generator, the non-volatile memory 104 is an example of a memory. Further, the timer 106 is an example of a timer, and the CPU 101 is an example of a controller. Further, the local connection I/F 111 and the network connection I/F 112 are examples of a receiving interface.

Further modifications will be described below.

When the non-energized time length of the timer 106 is estimated, the number of transitions (from the non-energized state to the energized state) of the state of the timer 106 of the previous suction purge was executed may also be referred to, in addition to the count value of the energized time length counter 104*b* and the time length parameters 104*b*.

For example, an average energized time length per one energized state may be calculated based on the number of transitions (from the non-energized state to the energized state) of the timer 106 after the non-energized time length was previously estimated and the count value of the energized time length counter 104*c*, and the non-energized time length may be estimated also taking the calculated average energized time length into account.

For example, even if the count value of the energized time length counter 104*c* is equal to or larger than the time length parameters 104*b* (e.g., six hours), as far as the average energized time length is less than six hours, there remains a possibility that the non-energized time length estimated by the first compensation may be smaller than the actual non-energized time length, as shown in FIG. 5A.

Therefore, when the average energized time length is less than six hours, the non-energized time length may be estimated to be longer than the non-energized time length estimated in the first compensation by a particular length. Further, when the average energized time length per one energized state, which is calculated based on the accumulated energized time length elapsed from the previous execution of the suction purge and the number of transitions of state elapsed from the previous execution of the suction purge, becomes less than a particular value, the non-energized time length may be estimated to be longer by a particular length than the non-energized time length estimated in the first compensation.

In the illustrative embodiments, when the count value of the energized time length counter 104*c* is 24 hours or more and less than 96 hours, or 168 hours or more, a value added to the count value of the lapse time length counter 104*a* is zero. This configuration may be modified such that a particular time is added. When the count value of the energized time length counter 104*c* is larger than the second time value (i.e., 96 hours) of the set time information 104*f*, a particular time value may be added regardless of the count value of the energized time length counter 104*c*.

In the above-described illustrative embodiments, estimation of the non-energized time length is executed at each time point where the state of the timer 106 is changed from the non-energized state to the energized state. This configuration may be modified such that the estimation of the non-energized time length may be triggered by another condition.

It is noted that the time length parameters 104*b* are defined as parameters indicating a ratio of the energized time length for one day (i.e., 24 hours) assuming that a day is the fundamental cycle time length. Aspects of the present disclosures need not be limited to such a definition, and the fundamental cycle time length may be defined based on another cyclic time length such as a week, a month and the like.

For example, when the fundamental cycle time length is one week, the first time value of the time length parameters 104*b* indicates an amount related to the accumulated energized time length in one week. Then, when the count value of the energized time length counter 104*c* is equal to or larger than the first time value, it is assumed that one week has passed, and a value calculated by subtracting the count value of the energized time length from 168 hours as the estimate value of the non-energized time length.

If the energized state of the timer 106 has a cyclic nature, the fundamental cycle time length may be determined based on the cyclic nature of the energized state of the timer 106. That is, a time length in which a ratio of the energized time length of the timer 106 to the non-energized time length of the timer 106 tends to have a substantially constant value is repeated, such a time length may be defined as the fundamental cycle time length.

For example, when the timer 106 has an approximate power receiving tendency such that a three-hour energized state and one-hour non-energized state are repeatedly alternate, the fundamental cycle time length may be defined to be four hours, and the first time value of the time length parameters 104*b* may be defined to be three hours.

As the lapse time length counter, a first counter for estimation and a second counter for measurement may be provided. In such a case, the non-energized time length which is estimated based on the energized time length of the timer 106 may be accumulated, while the non-energized time length calculated based on the time information obtained from the external device 121 may be accumulated.

According to the above configuration, when the timer 106 is in the energized state and the time information is received from the external device 121, the lapse time length may be calculated based on the count value of the second counter for measurement. Further, when the timer 106 is in the energized state and the time information is not received from the external device 121, the lapse time length may be calculated based on the count value of the first counter for estimation.

In the second illustrative embodiment, the non-energized time length calculated based on the reception interval length based on the time information received from the external device 121, and the count value of the second energized time length counter 104*g* may be compensated depending on the reliability of the reception interval length.

For example, when the reliability of the reception interval length is low, a particular time amount may be added to or subtracted from the calculated non-energized time length. Further, an upper limit value of the non-energized time length may be defined in advance depending on the reliability of the reception interval length, and when the calculated non-energized time length exceeds the upper limit value corresponding to the determined reliability, the non-energized time length may be regarded to be the upper limit value.

As above, the non-energized time length may be calculated based on the reception interval length based on the time information received from the external device 121, the count value of the second energized time length counter 104*g*, and the reliability of the reception interval length.

In the second illustrative embodiment, the reliability of the reception interval length is determined in two stages. This configuration may be modified such that the reliability may be determined in three or more stages. Further, the first sequence of the maintenance device 6 may include three or more sequences respectively corresponding to the number of the stages of the reliability.

For example, according to the second illustrative embodiment, in a case where the transmission source of the first time information and the transmission source of the second time information are the same, and in a case where the transmission source of the first time information and the transmission source of the second time information are the external devices 121 connected to the Internet 115, the reliabilities are the same. However, the reliabilities in the above cases may be differentiated. Further, the configuration may be modified such that the reliability of the reception interval length may not be determined, and the maintenance device 6 may be controlled in accordance with the same first control sequence when the count value of the lapse time length counter 104*a* is the measured lapse time length count value.

In the second illustrative embodiment, the low-reliability sequence and the high-reliability sequence are the sequences in which the execution intervals of the suction purge are the same. It is noted that the execution intervals may be differentiated. In such a case (i.e., when the execution intervals are different in the low-reliability sequence and in the high-reliability sequence), the amounts of the ink discharged from the nozzles 40 in the suction purge may be the same.

In the illustrative embodiment, the non-energized time length is calculated based on the time information received from the external device 121, and then, based on the calculated non-energized time length, the lapse time length elapsed from the previous execution of the suction purge is calculated. It is noted, however, calculation of the non-energized time length may be omitted.

For example, when the time point where the previous suction purge was executed and the time point where the time information was received from the external device 121 are the same, the lapse time elapsed from the previous execution of the suction purge when the next time information is received from the external device 121 is assumed to be the same time length as the reception interval length calculated based on the time information.

In the illustrative embodiments, the first control sequence and the second control sequence are different both in the amount of the ink discharged in the suction purge, and in the execution interval of the suction purge. The configuration may be modified such that the first control sequence and the second control sequence are only different in the amount of the ink discharged in the suction purge, or in the execution interval of the suction purge.

When there is a tendency that the non-energized time length estimated based on the energized time length of the timer 106 is longer than the actual non-energized time length, the second control sequence may be configured such that the amount of the ink discharged from the nozzles 30 is smaller, or the execution interval of the suction purge is longer in comparison with the first control sequence.

The second control sequence may be configured to include a plurality of control sequences, which are selectively used to control the maintenance device 6 depending on the ratio of the non-energized time length added by the first through third compensations.

In the second illustrative embodiment, the time information is obtained from the external device 121. The aspects of the disclosures need not be limited to the above configuration, and the time information may be obtained through the user I/F 90 to which the user may input the time information. In the second illustrative embodiment, the non-energized time length is estimated based on the energized time length of the timer 106. Such a configuration may be modified, and the non-energized time length may be estimated based on information the printer 1 can internally obtain. For example, the non-energized time length may be estimated based on the atmospheric temperature obtained from the temperature sensor 91.

Concretely, the atmospheric temperature through a year has a recognizable pattern. In general, there is the coldest day of which day-average temperature is the lowest throughout a year in around February, and there is the hottest day of which day-average temperature is the highest throughout a year in around August. Further, approximately, the day-average temperature keeps rising from the coldest day to the hottest day, while the day-average temperature keeps decreasing from the hottest day to the coldest data.

Further, an interval between the coldest day and the hottest day is approximately 180 days. Therefore, by obtaining atmospheric temperature data for each day and storing the same in relation with time series information in the non-volatile memory 104 when the timer 106 is in the energized sate, when the timer 106 is in the non-energized state and the atmospheric temperature data cannot be obtained, the non-energized time length in the non-energized state can be estimated approximately based on the transition of the atmospheric temperature data stored in the volatile memory 104.

In the first and second illustrative embodiments, the maintenance device 6 is controlled based on the lapse time length which is calculated from the time information obtained from the energized time length of the timer 106 or the external device 121. What is controlled need not be limited to the maintenance device 6, and another drivable part may be controlled.

For example, the ink around the nozzles 30 of the inkjet head 23 is thickened with passage of time. Therefore, the degree of thickening of the ink around the nozzles 30 is estimated based on the calculated lapse time length, and the driving IC 35 may be controlled such that the driving voltage supplied to the driving elements which apply discharging energies to the ink inside the nozzles 30 in accordance with the estimated degree of thickening of the ink.

In the first and second illustrative embodiments, the start point of the lapse time length to be calculated is the time point of the previous suction purge. Aspects of the disclosures need not be limited to the above configuration, and the start point may be one of the time points where the state of the timer 106 is changed from the non-energized state to the energized state. That is, the start point may be the time point where the timer 196 start receiving the driving electrical power from the power generator 95. When the start point for calculating the lapse time length and the time point where the state of the timer 106 is changed from the non-energized sate to the energized state coincide with each other, the non-energized time length based on the energized time length can be estimated accurately.

The printer 1 may further be provided with a chargeable battery which can be connected to the timer 106. The chargeable battery may charge the electrical power supplied by the power generator 95, and when the power circuit 95 does not supply the electrical power to the timer 106 (e.g., when the power plug is removed from the electrical outlet), the chargeable battery supplies the charged electrical power to the timer 106 as the driving electrical power. With this configuration, when the timer 106 cannot receive the driving electrical power from the power generator 95, the timer 106 can keep measuring the time for a particular period as the driving electrical power is supplied from the chargeable battery.

Even in such a case, if the interval during which the power plug is removed from the electrical outlet becomes long, the chargeable battery runs out of the charge, there would exist an interval where the no driving electrical power is supplied to the timer 106 as in the above-described embodiments, and it becomes necessary to estimate the non-energized time length of the timer.

In such a case, the approximate power receiving tendency of the timer 106 may include the approximate usage tendency of the user and a drivable time length of the timer 106 with only the chargeable battery.

It is noted that the above-described configurations can be applied to a so-called line printer type inkjet printer which is generally configured to print an image on a sheet conveyed by a conveying mechanism with the inkjet head being fixed. Further, the above-described configurations may be applied to various types of image recording apparatuses including a laser printer, a thermal printer, a copier, a facsimile machine and the like.

What is claimed is:

1. An image recording apparatus, comprising:

a timer;

a power generator configured to receive electrical power from a power supply, and supply the electrical power to the timer as driving electrical power;

a memory; and a controller, wherein the memory storing a time length parameter representing a ratio of an energized time length when the timer is in an energized state where the timer is receiving the driving electrical power from the power generator to a fundamental cycle time length which is a time length parameter used for estimation of a non-energized time length when the timer is in an non-energized state where the timer is not receiving the driving electrical power from the power generator and is based on a cyclic nature of a calendar, the controller being configured to execute:

a storing process of calculating the energized time length during which the timer is in the energized state after a particular calculation start point based on a time measured by the timer and storing the energized time length as calculated;

a determining process of determining whether there exists the non-energized state after the calculation start point;

an estimation process of estimating the non-energized time length, referring to the energized time length and the time length parameter stored in the memory when it is determined in the determining process that there exists the non-energized state after the calculation start point; and a lapse time length calculation process of calculating a lapse time length elapsed from the calculation start point based on the non-energized time length estimated in the estimation process and the energized time length stored in the memory.

2. The image recording apparatus according to claim 1, wherein the memory is configured to store lapse time length count value representing the lapse time length elapsed from the calculation start point, wherein the controller is configured to:

execute the estimation process at each time point when the state of the timer is changed from the non-energized state to the energized state;

add, in the storing process, the energized time length calculated based on the time measured by the timer to the lapse time length count value; and compensate the lapse time length count value by adding the non-energized time length estimated in the estimation process, and use the compensated lapse time length as the lapse time length elapsed from the calculation start point in the lapse time length calculation process.

3. The image recording apparatus according to claim 2, wherein the memory is configured to store an energized time length count value representing the energized time length, wherein the controller is configured to:

store, in the storing process, the energized time length calculated based on the time measured by the timer after a later one of the calculation start point and the time point at which the estimation of the non-energized time length was previously estimated as the energized time length count value; and estimate, in the estimation process, the non-energized time length elapsed from the time point where the previous estimation of the non-energized time length was executed in the estimation process referring to the energized time length count value and the time length parameter stored in the memory.

4. The image recording apparatus according to claim 3, wherein the fundamental cycle time length is 24 hours, wherein the memory includes a first time value, which is less than 24 hours, as the time length parameter, and wherein the controller is configured to:

estimate, in the estimation process, the time length calculated by subtracting the energized time length count value from 24 hours when the energized time length count value stored in the memory is greater than or equal to the first time value; and not estimate the non-energized time length when the energized time length count value stored in the memory is less than the first time value.

5. The image recording apparatus according to claim 4, wherein the first time value is six hours.

6. The image recording apparatus according to claim 4, wherein the controller is configured to execute an addition process of adding 48 hours to the lapse time length count value at every five executions of estimation of the non-energized time length in the estimation process.

7. The image recording apparatus according to claim 4, wherein the controller is configured to execute an addition process of adding 24 hours to the lapse time length count value at every six executions of estimation of the non-energized time length in the estimation process.

8. The image recording apparatus according to claim 4, wherein the controller is configured to compensate the lapse time length count value by adding a particular time length to the lapse time length count value when the energized time length stored in the memory is greater than or equal to a second time value which is 24 hours.

9. The image recording apparatus according to claim 1, wherein the controller is configured to:

store, in the storing process, the number of times of transition, which is a change of the state of the timer from the non-energized state to the energized state, after the calculation start point; and estimate, in the estimation process, the non-energized time length based on the energized time length, the number of times of transition, and the time length parameter stored in the memory.

10. The image recording apparatus according to claim 1, wherein the controller is configured to execute a controlling process of controlling the image recording process to execute a particular operation based on the lapse time length from the calculation start point calculated in the lapse time length calculation process.

11. The image recording apparatus according to claim 10, further comprising:

an image recording device configured to record an image on a recording medium; and a maintenance device configured to execute maintenance of the image recording device, wherein the calculation start point is a time point where previous maintenance was executed by the maintenance device, and wherein the controller is configured to control, in the controlling process, the maintenance device based on the lapse time length elapsed from the calculation start point calculated in the lapse time length calculation process.

12. The image recording apparatus according to claim 1, wherein the calculation start point is a time point where the state of the timer was changed from the non-energized state to the energized state previously.

13. An image recording apparatus, comprising:

a timer;

a power generator configured to receive electrical power from a power supply, and supply the electrical power to the timer as driving electrical power;

a memory; and a controller, wherein the memory storing a time length parameter representing a ratio of an energized time length when the timer is in an energized state where the timer is receiving the driving electrical power from the power generator to a fundamental cycle time length which is a time length parameter used for estimation of a non-energized time length when the timer is in an non-energized state where the timer is not receiving the driving electrical power from the power generator and is based on a cyclic nature of a receiving state, in the timer, of the driving electrical power from the power generator, the controller being configured to execute:

a storing process of calculating the energized time length during which the timer is in the energized state after a particular calculation start point based on a time measured by the timer and store the energized time length as calculated;

a determining process of determining whether there exists the non-energized state after the calculation start point;

an estimation process of estimating the non-energized time length, referring to the energized time length and the time length parameter stored in the memory when it is determined in the determining process that there exists the non-energized state after the calculation start point; and a lapse time length calculation process of calculating a lapse time length elapsed from the calculation start point based on the non-energized time length estimated in the estimation process and the energized time length stored in the memory.

14. The image recording apparatus according to claim 13, wherein the memory stored lapse time length count value representing the lapse time length elapsed from the calculation start point, wherein the controller is configured to execute:

the estimation process at each time point when the state of the timer is changed from the non-energized state to the energized state;

add, in the storing process, the energized time length calculated based on the time measured by the timer to the lapse time length count value; and compensate the lapse time length count value by adding the non-energized time length estimated in the estimation process, and regard the compensated lapse time length as the lapse time length elapsed from the calculation start point in the lapse time length calculation process.

15. The image recording apparatus according to claim 14, wherein the memory is configured to store an energized time length count value representing the energized time length, wherein the controller is configured to:

store, in the storing process, the energized time length calculated based on the time measured by the timer elapsed from a later one of the calculation start point and the time point at which the estimation of the non-energized time length was previously estimated as the energized time length count value; and estimate, in the estimation process, the non-energized time length elapsed from the time point where the previous estimation of the non-energized time length was executed in the estimation process referring to the energized time length count value and the time length parameter stored in the memory.

16. The image recording apparatus according to claim 15, wherein the fundamental cycle time length is 24 hours, wherein the memory includes a first time value, which is less than 24 hours, as the time length parameter, and wherein the controller is configured to:

estimate, in the estimation process, the time length calculated by subtracting the energized time length count value from 24 hours when the energized time length count value stored in the memory is equal to or greater than the first time value;

not estimate the non-energized time length when the energized time length count value stored in the memory is less than the first time value.

17. An image recording apparatus, comprising:

a timer;

a power generator configured to receive electrical power from a power supply, and supply the electrical power to the timer as driving electrical power;

a memory; and a controller, the controller being configured to execute:

a storing process of storing a measured time length measured by the timer from a calculation start point, which is a start point to calculate the lapse time length when the timer in an energized state where the timer is receiving a driving electrical power from the power generator;

a state determining process of determining whether there has occurred a non-energized state where the timer is not receiving the driving electrical power after the calculation start point, when it is determined in the state determining process that there exists the non-energized state after the calculation start point, a condition determining process of determining whether a condition in which the receiving interface newly receives second time information as the time information when the receiving interface has externally received first time information as the time information, and after the state of the timer has changed from the non-energized sate to the energized state;

when it is determined that the condition is not satisfied in the condition determining process, an estimate process estimating the non-energized time length referring to internal information obtained inside the image recording process;

when it is determined that the condition is satisfied in the condition determining process, calculate a lapse time length elapsed from the calculation start point as a measured time length referring to the first time information and the second time information, when it is determined that the condition is not satisfied in the condition determining process, a lapse time length calculation process of calculating a lapse time elapsed from the calculation start point as an estimate time length based on the non-energized time length estimated in the estimation process and the clocked time length stored in the memory.

18. The image recording apparatus according to claim 17, wherein, in the lapse time length calculation process, the controller is configured to calculate:

a non-energized time length when the timer is in the non-energized state referring to the first time information, the second time information and the clocked time length stored in the memory when it is determined that the condition; and the measured time length based on the non-energized time length as calculated and the clocked time length stored in the memory.

19. The image recording apparatus according to claim 18, wherein the controller is configured to store, in the storing process, a first clocked time length which is measured, by the timer, from the calculation start point, and second clocked time length which is measured, by the timer, from a time point where the receiving interface externally receives the first time information to a time point where the receiving interface receives the second time information as the clocked time lengths, and wherein, when it is determined in the condition determining process that the condition is satisfied, in the lapse time length calculation process:

calculate a time length obtained by subtracting the second clocked time length stored in the memory from a time length between a time represented by the first time information and a time represented by the second time information as the non-energized time length; and calculate a time length by adding the calculated non-energized time length to the first clocked time length stored in the memory as the measured time length.

20. The image recording apparatus according to claim 17, wherein the controller is further configured to execute a controlling process of controlling an operation of the image recording apparatus based on the lapse time length from the calculation start point calculated in the lapse time length calculation process.

* * * * *